US011499555B2

(12) United States Patent
Noh et al.

(10) Patent No.: US 11,499,555 B2
(45) Date of Patent: Nov. 15, 2022

(54) VANE ROTARY COMPRESSOR

(71) Applicant: LG ELECTRONICS INC., Seoul (KR)

(72) Inventors: Kiyoul Noh, Seoul (KR); Seokhwan Moon, Seoul (KR); Joonhong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 345 days.

(21) Appl. No.: 16/734,679

(22) Filed: Jan. 6, 2020

(65) Prior Publication Data

US 2020/0277956 A1 Sep. 3, 2020

(30) Foreign Application Priority Data

Feb. 28, 2019 (KR) ..... 10-2019-0024256

(51) Int. Cl.
*F04C 18/344* (2006.01)
*F04C 29/02* (2006.01)
*F04C 15/06* (2006.01)

(52) U.S. Cl.
CPC ..... *F04C 18/3441* (2013.01); *F04C 15/064* (2013.01); *F04C 29/023* (2013.01); *F04C 2210/206* (2013.01); *F04C 2240/603* (2013.01)

(58) Field of Classification Search
None
See application file for complete search history.

(56) References Cited

U.S. PATENT DOCUMENTS

| | | | | |
|---|---|---|---|---|
| 4,512,728 | A | 4/1985 | Nakano | |
| 4,867,658 | A | 9/1989 | Sugita et al. | |
| 11,346,344 | B2 * | 5/2022 | Noh | F04C 29/128 |
| 2005/0175494 | A1 | 8/2005 | Shibamoto | |

(Continued)

FOREIGN PATENT DOCUMENTS

| | | |
|---|---|---|
| EP | 3 401 543 | 11/2018 |
| JP | 59-082597 | 5/1984 |

(Continued)

OTHER PUBLICATIONS

Machine Translation JP 2000-257576, obtained from https://worldwide.espacenet.com/on Jun. 2022 (Year: 2022).*

(Continued)

*Primary Examiner* — Essama Omgba
*Assistant Examiner* — Geoffrey S Lee
(74) *Attorney, Agent, or Firm* — KED & Associates

(57) ABSTRACT

A vane rotary compressor may include a main bearing and a sub bearing provided with a plurality of back pressure pockets each having a different pressure formed on a surface facing the cylinder, a rotational shaft radially supported by the main bearing and the sub bearing, a roller provided with a back pressure chamber that communicates with the plurality of back pressure pockets and having a plurality of vanes configured to divide a compression space into a plurality of compression chambers. At least one of the main bearing or the sub bearing is provided with an oil supply passage that communicates with a back pressure pocket having a relatively low pressure among the plurality of back pressure pockets. Accordingly, oil may be smoothly supplied to a back pressure pocket having a low pressure.

11 Claims, 13 Drawing Sheets

(56) References Cited

U.S. PATENT DOCUMENTS

| | | | |
|---|---|---|---|
| 2014/0286807 | A1 | 9/2014 | Sekiya |
| 2015/0064042 | A1 | 3/2015 | Shimaguchi et al. |
| 2018/0080446 | A1 | 3/2018 | Choi et al. |
| 2018/0328364 | A1 | 11/2018 | Kim et al. |

FOREIGN PATENT DOCUMENTS

| | | | | |
|---|---|---|---|---|
| JP | 2000-257576 | | | 9/2000 |
| JP | 2000257576 | A | * | 9/2000 |
| JP | 2001-295782 | | | 10/2001 |
| JP | 2002-048080 | | | 2/2002 |
| JP | 2015-137576 | | | 7/2015 |
| JP | 2017-082756 | | | 5/2017 |
| KR | 10-2016-0138750 | | | 12/2016 |
| KR | 10-2018-0095391 | | | 8/2018 |
| KR | 10-2018-0116984 | | | 10/2018 |

OTHER PUBLICATIONS

U.S. Office Action issued in U.S. Appl. No. 16/734,755 dated Aug. 23, 2021.
European Search Report dated Jul. 10, 2020 issued in EP Application No. 20157509.9.
Korean Office Action dated Mar. 16, 2020 issued in Application No. 10-2019-0021340.
Korean Office Action dated Mar. 20, 2020 issued in Application No. 10-2019-0024256.
U.S. Appl. No. 16/734,755, filed Jan. 6, 2020.

* cited by examiner

VANE ROTARY COMPRESSOR

CROSS-REFERENCE TO RELATED APPLICATION(S)

Pursuant to 35 U.S.C. § 119(a), this application claims the benefit of earlier filing date and right of priority to Korean Application No. 10-2019-0024256, filed in Korea on Feb. 28, 2019, the contents of which is incorporated by reference herein in its entirety.

BACKGROUND

1. Field

A compressor, and more particularly, a vane rotary compressor in which a vane that protrudes from a roller comes in contact with an inner circumferential surface of a cylinder to form a compression chamber is disclosed herein.

2. Background

A rotary compressor may be divided into two types, namely, a type in which a vane is slidably inserted into a cylinder to come in contact with a roller, and another type in which a vane is slidably inserted into a roller to come in contact with a cylinder. Normally, the former is referred to as a 'rotary compressor' and the latter is referred to as a 'vane rotary compressor'.

As for a rotary compressor, a vane inserted in a cylinder is pulled out toward a roller by elastic force or back pressure to come into contact with an outer circumferential surface of the roller. On the other hand, for a vane rotary compressor, a vane inserted in a roller rotates together with the roller, and is pulled out by centrifugal force and back pressure to come into contact with an inner circumferential surface of a cylinder.

A rotary compressor independently forms as many compression chambers as a number of vanes per revolution of a roller, and each compression chamber simultaneously performs suction, compression, and discharge strokes. On the other hand, a vane rotary compressor continuously forms as many compression chambers as a number of vanes per revolution of a roller, and each compression chamber sequentially performs suction, compression, and discharge strokes. Accordingly, the vane rotary compressor has a higher compression ratio than the rotary compressor. Therefore, the vane rotary compressor is more suitable for high pressure refrigerants, such as R32, R410a, and CO2, which have low ozone depletion potential (ODP) and global warming index (GWP).

Such a vane rotary compressor is disclosed in Japanese Laid-Open Patent Application No. JP 2015-137576A (hereinafter, "Patent Document", published on Jul. 30, 2015 which is hereby incorporated by reference. This related art vane rotary compressor is a low-pressure type in which a suction refrigerant is filled in an inner space of a motor room but has a structure in which a plurality of vanes is slidably inserted into a rotating roller, which is features of a vane rotary compressor.

As disclosed in the Patent Document, back pressure chambers 13 are formed at rear end portions of vanes, respectively, communicating with back pressure pockets 45 and 44. The back pressure pockets are divided into a first pocket 45 having a first intermediate pressure and a second pocket 44 having a second intermediate pressure higher than the first intermediate pressure and close to a discharge pressure. Oil is depressurized between a rotational shaft and a bearing and introduced into the first pocket through a gap between the rotational shaft and the bearing. On the other hand, oil is introduced into the second pocket, with almost no pressure loss, through a flow path 73 penetrating through the bearing due to the gap between the rotational shaft, which is an inner circumferential side of the second pocket, and the bearing is blocked. Therefore, the first pocket communicates with a back pressure chamber located at an upstream side, and the second pocket communicates with a back pressure chamber located at a downstream side based on a direction toward a discharge portion from a suction portion.

As for a low-pressure type vane rotary compressor, oil is depressurized through a space (or gap) between a rotational shaft and a bearing, and is then introduced into a first pocket forming an intermediate pressure. On the other hand, in a high-pressure type vane rotary compressor, oil is introduced into a first pocket via an oil flow path penetrating through a rotational shaft and an oil passage hole formed through a middle portion of the oil flow path in a radial direction. Accordingly, in the high-pressure type vane rotary compressor, an inner circumferential side of the first pocket forming the intermediate pressure is blocked, and thus, oil introduced into the rotational shaft and a beating is depressurized while flowing through a gap between the bearing and a roller, and is then introduced into the first pocket.

However, in the related art high-pressure type vane rotary compressor, as described above, oil flows into the first pocket through a narrow gap between the bearing and the roller as the inner circumferential side of the first pocket forming the intermediate pressure is blocked. However, as the gap between the bearing and the roller is narrow, oil is not smoothly and continuously introduced into the first pocket, or an excessive amount of oil is introduced into the first pocket depending on an operating condition, and accordingly, pressure of the first pocket becomes unstable.

In addition, when oil is not smoothly and continuously introduced into the first pocket, sufficient pressure cannot be formed in a back pressure chamber communicating with the first pocket. Then, a rear side of a vane cannot be stably supported, and thus, a sealing force of the vane is decreased accordingly. As a result, leakage between compression chambers occurs as the vane is separated from a cylinder, or noise and abrasion occur due to shaking vibration) generated by unstable behavior of the vane.

Further, when oil is not smoothly and continuously introduced into the first pocket, friction loss or abrasion caused by insufficient lubricating between the bearing and the roller occurs, thereby decreasing mechanical efficiency. This may be particularly problematic when a high-pressure refrigerant, such as R32, R410a, and CO2, is used. When high-pressure refrigerant is used, the same level of cooling capability may be obtained as that when using a relatively low-pressure refrigerant, such as R134a, even though the volume of each compression chamber is reduced by increasing the number of vanes. However, if the number of vanes is increased, vane behavior becomes unstable due to pressure instability of the first pocket. Accordingly, as described above, compression efficiency may be decreased as leakage between the compression chambers is increased, or mechanical efficiency may be reduced as friction loss is increased. This may be even worse under a low-temperature heating condition, a high pressure ratio condition ($Pd/Ps \geq 6$), and a high-speed operating condition (above 80 Hz).

BRIEF DESCRIPTION OF THE DRAWINGS

Embodiments will be described in detail with reference to the following drawings in which like reference numerals refer to like elements, and wherein:

FIG. 2 is a cross-sectional view taken along line "II-II" of FIG. 1, and FIG. 3 is a cross-sectional view taken along line "III-III" of FIG. 2;

DETAILED DESCRIPTION

Description will now be given of a vane rotary compressor according to embodiments disclosed herein, with reference to the accompanying drawings.

Figure 1:
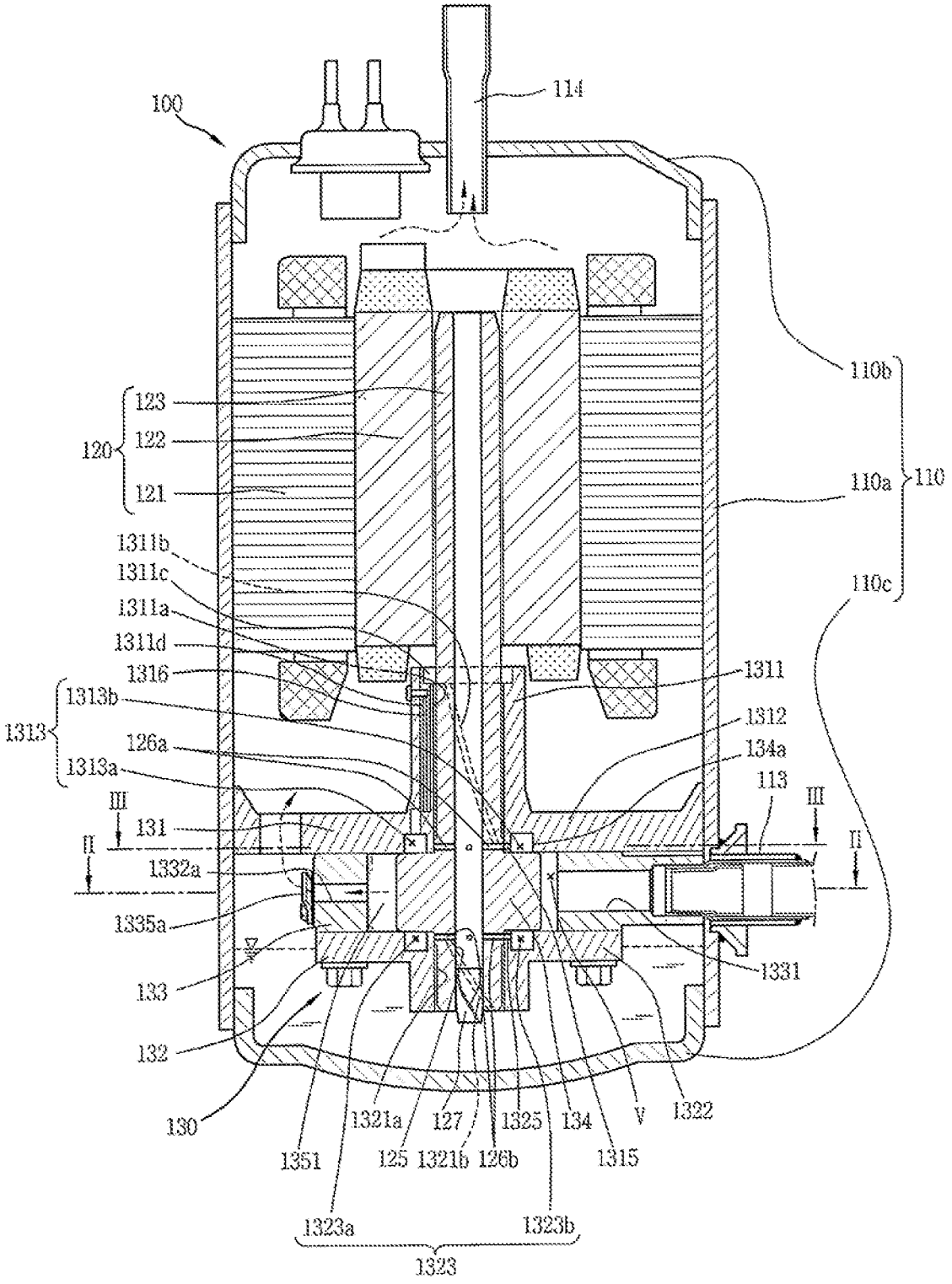
FIG. 1 is a longitudinal cross-sectional view of a vane rotary compressor according to an embodiment.
Figure 2:
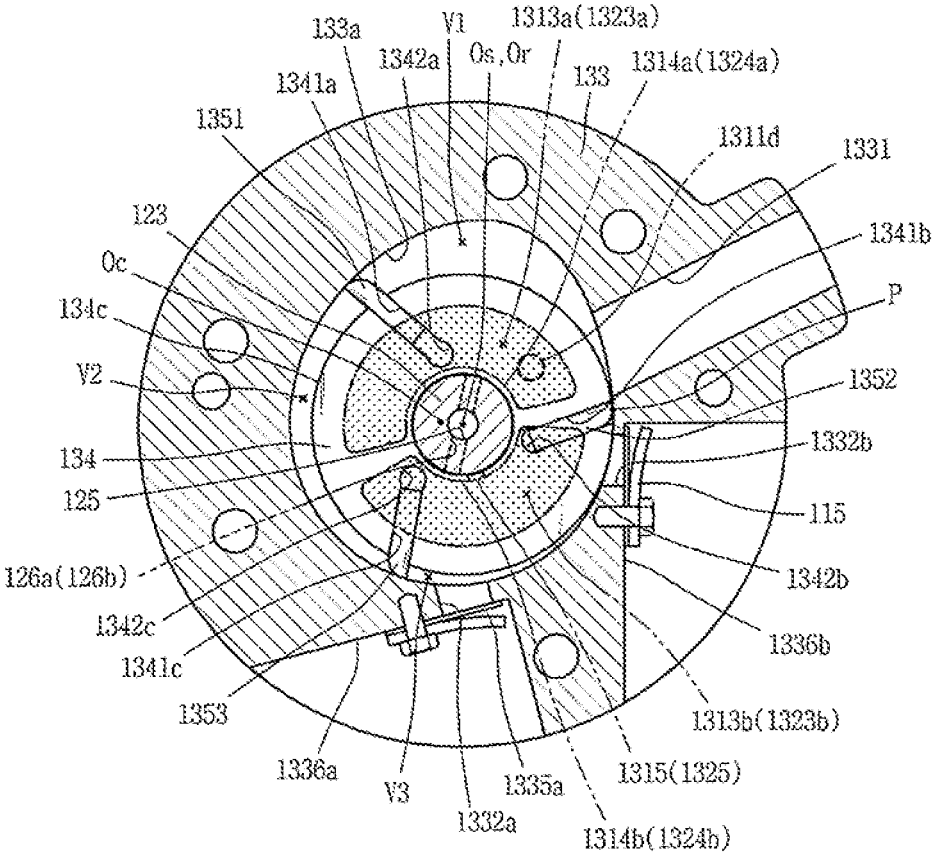
FIGS. 2 and 3 are horizontal cross-sectional views of a compression unit applied in FIG. 1, namely.
Figure 3:
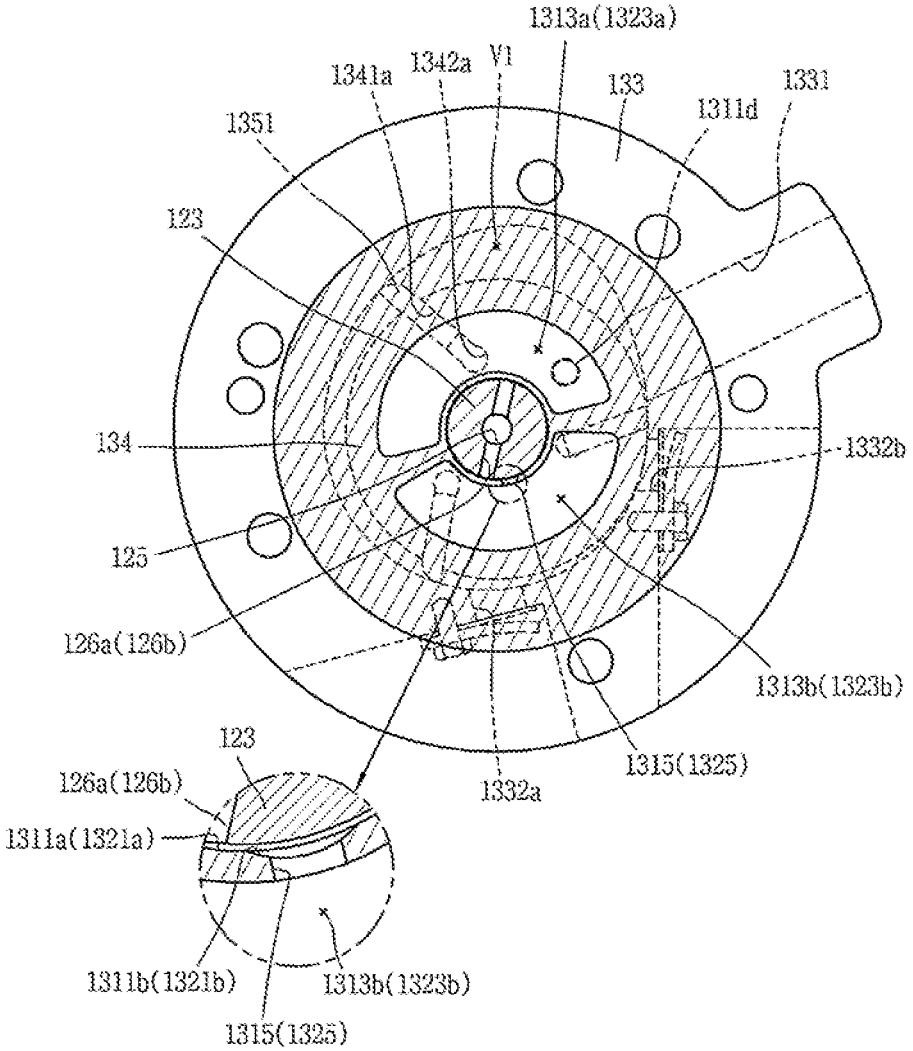

FIG. 1 is a longitudinal cross-sectional view of a vane rotary compressor according to an embodiment. FIGS. 2 and 3 are horizontal cross-sectional views of a compression unit applied in FIG. 1. FIG. 2 is a cross-sectional view taken along line "II-II" of FIG. 1. FIG. 3 is a cross-sectional view taken along line "III-III" of FIG. 2.

Referring to FIG. 1, a vane rotary compressor according to an embodiment may include a drive motor 120 installed in a casing 110, and a compression part or unit 130 provided at one side of the drive motor 120 and mechanically connected to the drive motor 120 by a rotational shaft 123.

The casing 110 may be classified as a vertical type or a horizontal type according to a compressor installation method. As for the vertical-type casing, the drive motor and the compression part are disposed at both upper and lower sides along an axial direction. As for the horizontal-type casing, the drive motor and the compression part are disposed at both lateral or left and right sides.

The drive motor 120 provides power for compressing a refrigerant. The drive motor 120 may include a stator 121, a rotor 122, and the rotational shaft 123.

The stator 121 may be fixedly inserted into the casing 110. The stator 121 may be mounted on an inner circumferential surface of the cylindrical casing 110 in a shrink-fitting manner, for example. For example, the stator 121 may be fixedly mounted on an inner circumferential surface of an intermediate shell 110*a*.

The rotor 122 may be disposed spaced apart from the stator 121 and located at an inner side of the stator 121. The rotational shaft 123 may be, for example, press-fitted into a central part or portion of the rotor 122. Accordingly, the rotational shaft 123 coupled to the rotor 122 rotates concentrically together with the rotor 120.

An oil flow path 125 may be formed in a central part or portion of the rotational shaft 123 in an axial direction, and oil passage holes 126*a* and 126*b* may be formed through a middle part or portion of the oil flow path 125 toward an outer circumferential surface of the rotational shaft 123. The oil passage holes 126*a* and 126*b* may include a first oil passage hole 126*a* disposed in a range of a first boss portion 1311 and a second oil passage hole 126*b* disposed in a range of a second boss portion 1321. One or a plurality of each of the first oil passage hole 126*a* and the second oil passage hole 126*b* may be provided. This embodiment shows an example in which a plurality of oil passage holes is formed.

An oil feeder 127 may be installed at a middle or lower end of the oil flow path 125. Accordingly, when the rotational shaft 123 rotates, oil filled in a lower part or portion of the casing may be pumped by the oil feeder 127 and suctioned along the oil flow path 125, so as to be introduced into a radial bearing surface of the second boss portion 1321 (hereinafter, "sub-side first bearing surface") [1321*a*] through the second oil passage hole 126*b* and introduced into a radial bearing surface of the first boss portion 1311 (hereinafter, "main-side first bearing surface") [1311*a*] through the first oil passage hole 126*a*.

The first oil passage hole 126*a* and the second oil passage hole 126*b* may face a first oil groove 1311*b* and a second oil groove 1321*b*, respectively, in a communicating manner, which are discussed hereinafter. Oil introduced into the main-side first bearing surface 1311*a* and the sub-side first bearing surface 1321*a* via the first oil passage hole 126*a* and the second oil passage hole 126*b*, respectively, may lubricate the first bearing surfaces 1311*a* and 1321*a* through the respective oil grooves 1311*b* and 1321*b* quickly and evenly. In particular, oil flowing into the first oil groove 1311*b* may be quickly supplied to the main-side first pocket 1313*a* through an oil accommodating groove 1311*c* and an oil supply hole 1311*d* described hereinafter, which allows a sufficient amount of oil to be introduced into the main-side first pocket 1313*a* and the sub-side first pocket 1323*a*.

The compression unit 130 may include a cylinder 133 in which a compression space V may be formed by the main bearing 131 and the sub bearing 131 installed on both sides thereof in an axial direction.

Referring to FIGS. 1 and 2, the main bearing 131 and the sub bearing 132 may be fixedly installed on the casing 110 and spaced apart from each other along the rotational shaft 123. The main bearing 131 and the sub bearing 132 may radially support the rotational shaft 123 and axially support the cylinder 133 and a roller 134 at the same time. As a result, the main bearing 131 and the sub bearing 132 may be provided with a boss portion 1311, 1321 that radially supports the rotational shaft 123, and a flange portion 1312, 1322 radially extending from the boss portion 1311, 1321. For convenience of explanation, the bearing portion and the flange portion of the main bearing 131 are defined as the first boss portion 1311 and the first flange portion 1312, respectively, and the bearing portion and the flange portion of the sub bearing 132 are defined as the second boss portion 1321 and the second flange portion 1322, receptively.

Referring to FIGS. 1 and 3, the first boss portion 1311 and the second boss portion 1321 may be formed in a circular shape, respectively, and the first flange portion and the second flange portion may be formed in a disk shape, respectively. The first oil groove 1311*b* may be formed on a radial bearing surface (hereinafter, referred to as "bearing surface" or "first bearing surface") 1311*a*, which is an inner circumferential surface of the first boss portion 1311, and the second oil groove 1321*b* may be formed on a radial bearing surface (hereinafter, referred as "bearing surface" or "second bearing surface") 1321*a*, which is an inner circumferential surface of the second boss portion 1321. The first oil groove 1311*b* may be formed linearly or diagonally between upper and lower ends of the first boss portion 1311, and the second oil groove 1321*b* may be formed linearly or diagonally between upper and lower ends of the second boss portion 1321.

The oil accommodating groove 1311*c* may be formed on an upper end surface of the first boss portion 1311 in a manner of communicating with the oil supply hole 1311*d* described hereinafter. The oil supply hole 1311*d* may guide oil accumulated in the oil accommodating groove 1311*c* to the main-side first pocket 1313*a*. Accordingly, an inner circumferential surface of the oil accommodating groove 1311*c* may communicate with an upper end of the first oil groove 1311*b*, and an outer circumferential surface of the oil accommodating groove 1311*c* may communicate with the oil supply hole 1311*d*.

An oil accommodating groove (not shown) with an annular shape may be formed on an end surface of the second boss portion 1321 like the first boss portion 1311, and an oil accommodating hole that guides oil from a middle part or portion of the oil accommodating groove of the second boss portion 1321 to the sub-side first pocket 1323*a* may also be formed. However, in the case of a vertical type compressor in which the compressor is installed in an axial direction, oil flowing into the end surface of the second boss portion 1321 through the second oil groove is recovered (or returned) to an inner space 111 of the casing 110 by self-weight, and thus, the oil accommodating groove and the oil supply hole may not necessarily be formed at the second boss portion 1321.

A first communication flow path 1315 may be formed in or at a middle of the first oil groove 1311*b* for communicating the first oil groove 1311*b* with a main-side second pocket 1313*b* described hereinafter, and the second oil groove 1321*b* may be provided with a second communication flow path 1325 for communicating the second oil groove 1321*b* with a sub-side second pocket 1323*b* described hereinafter.

The first flange portion 1312 may be provided with a main-side back pressure pocket 1313, and the second flange portion 1322 may be provided a sub-side back pressure pocket 1323. The main-side back pressure pocket 1313 may be provided with a main-side first pocket 1313*a* and a main-side second pocket 1313*b*, and the sub-side back pressure pocket 1323 may be provided with a sub-side first pocket 1323*a* and a sub-side second pocket 1323*b*.

The main-side first pocket 1313*a* and the main-side second pocket 1313*b* may be formed with a predetermined spacing therebetween along a circumferential direction, and the sub-side first pocket 1323*a* and the sub-side second pocket 1323*b* may be formed with a predetermined spacing therebetween along the circumferential direction.

The main-side first pocket 1313*a* forms a pressure lower than a pressure formed in the main-side second pocket 1313*b*, for example, forms an intermediate pressure between a suction pressure and a discharge pressure. The sub-side first pocket 1323*a* forms a pressure lower than a pressure formed in the sub-side second pocket 1323*b*, for instance, forms an intermediate pressure nearly the same as the pressure of the main-side first pocket 1313*a*. The main-side first pocket 1313*a* forms the intermediate pressure as oil with the discharge pressure suctioned into the first oil groove 1311*b* and the oil accommodating groove 1311*c* may be depressurized while passing through the oil supply hole 1311*d* described hereinafter. The sub-side first pocket 1323*a* may communicate with the main-side first pocket 1313*a*, thereby forming the intermediate pressure.

The main-side second pocket 1313*b* and the sub-side second pocket 1323*b* maintain the discharge pressure or a pressure almost equal to the discharge pressure as oil, which is introduced into the main bearing surface 1311*a* and the sub bearing surface 1321*a* through the first oil passage hole 126*a* and the second oil passage hole 126*b*, flows into the main-side second pocket 1313*b* and the sub-side second pocket 1323*b* through the first communication flow path 1315 and the second communication flow path 1325 described hereinafter.

An inner circumferential surface, which constitutes compression space V, of cylinder 133 may be formed in an elliptical shape. The inner circumferential surface of the cylinder 133 may be formed in a symmetric elliptical shape having a pair of major and minor axes. However, the inner circumferential surface of the cylinder 133 has an asymmetric elliptical shape having multiple pairs of major and minor axes in this embodiment of the present disclosure. This cylinder 133 formed in the asymmetric elliptical shape may be generally referred to as a hybrid cylinder, and this embodiment describes a vane rotary compressor to which such a hybrid cylinder is applied. However, a back pressure pocket structure according to embodiments may also be applied to a vane rotary compressor with a cylinder with a symmetrical elliptical shape.

As illustrated in FIGS. 2 and 3, an outer circumferential surface of the hybrid cylinder (hereinafter, referred to as "cylinder") 133 according to this embodiment may be formed in a circular shape. However, a non-circular shape may also be applied if it is fixed to an inner circumferential surface of the casing 110. Of course, the main bearing 131 and the sub bearing 132 may be fixed to the inner circumferential surface of the casing 110, and the cylinder 133 may be coupled to the main bearing 131 or the sub bearing 132 fixed to the casing 110 with, for example, a bolt.

In addition, an empty space may be formed at a central portion of the cylinder 133 so as to form compression space V including an inner circumferential surface. This empty space may be sealed by the main bearing 131 and the sub bearing 132 to form the compression space V. The roller 134 described hereinafter may be rotatably coupled to the compression space V.

The inner circumferential surface 133*a* of the cylinder 133 may be provided with an inlet port 1331 and outlet ports 1332*a* and 1332*b* on both sides in a circumferential direction with respect to a point P1 where the inner circumferential surface 133*a* of the cylinder 133 and an outer circumferential surface 134*c* of the roller 134 are almost in contact with each other.

The inlet port 1331 may be directly connected to a suction pipe 113 penetrating through the casing 110, and the outlet ports 1332*a* and 1332*b* may communicate with the inner space 111 of the casing 110, thereby being indirectly connected to a discharge pipe 114 coupled to the casing 110 in a penetrating manner. Accordingly, a refrigerant may be suctioned directly into the compression space V through the inlet port 1331 while compressed refrigerant may be discharged into the inner space 111 of the casing 110 through the outlet ports 1332*a* and 1332*b*, and may then be discharged to the discharge pipe 114. As a result, the inner space 111 of the casing 110 may be maintained in a high-pressure state forming the discharge pressure.

In addition, the inlet port 1331 may not be provided with an inlet valve, separately, however, the outlet port 1332*a*, 1332*b* may be provided with a discharge valve 1335*a*, 1335*b* that opens and closes the outlet port 1332*a*, 1332*b*. The discharge valve 1335*a*, 1335*b* may be a lead-type valve having one or a first end fixed and another or a second end free. However, various types of valves, such as a piston valve, other than the lead-type valve, may be used as the discharge valve 1335*a*, 1335*b* as necessary.

When the lead-type valve is used for the discharge valve 1335*a*, 1335*b*, a valve groove 1336*a*, 1336*b* may be formed on an outer circumferential surface of the cylinder 133 so as to mount the discharge valve 1335*a*, 1335*b*. Accordingly, a length of the outlet port 1332*a*, 1332*b* may be reduced to a minimum, thereby decreasing in dead volume. The valve groove 1336*a*, 1336*b* may be formed in a triangular shape so as to secure a flat valve seat surface, as illustrated in FIGS. 2 and 3.

On the other hand, a plurality of the outlet port 1332*a*, 1332*b* may be provided along a compression path (compression proceeding direction). For convenience of explanation, an outlet port located at an upstream side of the compression path is referred to as a sub outlet port (or a first outlet port) 1332*a*, and an outlet port located at a downstream side of the compression path is referred to as a main outlet port (or a second outlet port) 1332*b*.

However, the sub outlet port is not necessarily required and may be selectively formed as necessary. For example, the sub outlet port may not be formed on the inner circumferential surface 133*a* of the cylinder 133 if over-compression of a refrigerant is appropriately reduced by setting a long compression period, as will be described hereinafter. However, in order to minimize over-compression of refrigerant, the sub outlet port 1332*a* may be formed ahead of the main outlet port 1332*b*, that is, at an upstream side of the main outlet port 1332*b* based on the compression proceeding direction.

Referring to FIGS. 2 and 3, the roller 134 described above may be rotatably provided in the compression space V of the cylinder 133. An outer circumferential surface 134*c* of the roller 134 may be formed in a circular shape, and the rotational shaft 123 may be integrally coupled to the central part of the roller 134. In this way, the roller 134 has a center Or coinciding with an axial center Os of the rotational shaft 123, and concentrically rotates together with the rotational shaft 123 centering around the center Or of the roller 134.

The center Or of the roller 134 is eccentric with respect to a center Oc of the cylinder 133, that is, a center of the inner space of the cylinder 133 (hereinafter, referred to as "the center of the cylinder"), and one or a first side of the outer circumferential surface 134*c* of the roller 134 is almost in contact with the inner circumferential surface 133*a* of the cylinder 133. When an arbitrary point of the cylinder 133 where one side of the outer circumferential surface of the roller 134 is closest to the inner circumferential surface of the cylinder 133 and the roller 134 almost comes into contact with the cylinder 133 is referred to as a contact point P, a center line passing through the contact point P and the center of the cylinder 133 may be a position for a minor axis of the elliptical curve forming the inner circumferential surface 133*a* of the cylinder 133.

The roller 134 has a plurality of vane slots 1341*a*, 1341*b*, and 1341*c* formed in the outer circumferential surface thereof at appropriate places along a circumferential direction. Vanes 1351, 1352, and 1353 are slidably inserted into the vane slots 1341*a*, 1341*b*, and 1341*c*, respectively. The vane slots 1341*a*, 1341*b*, and 1341*c* may be formed radially with respect to the center of the roller 134. In this case, however, it is difficult to sufficiently secure a length of the vane. Therefore, the vane slots 1341*a*, 1341*b*, and 1341*c* may be formed to be inclined by a predetermined inclination angle with respect to a radial direction so that the length of the vane may be sufficiently secured.

A direction in which the vanes 1351, 1352 and 1353 are tilted may be an opposite direction to a rotational direction of the roller 134. That is, front surfaces of the vanes 1351, 1352, and 1353 in contact with the inner circumferential surface 133*a* of the cylinder 133 may be tilted in the rotational direction of the roller 134. This allows a compression start angle to be formed ahead in the rotational direction of the roller 134 so that compression may start quickly.

In addition, back pressure chambers 13442*a*, 1342*b*, and 1342*c* may be formed at inner ends of the vane slots 1341*a*, 1341*b*, and 1341*c*, respectively, to introduce oil (or refrigerant) into rear sides of the vanes 1351, 1352 and 1353, so as to push each vane toward the inner circumferential surface of the cylinder 133. For convenience, a direction toward the cylinder with respect to a motion direction of the vane is defined as a front side, and an opposite direction is defined as a rear side.

The back pressure chambers 1342*a*, 1342*b* and 1342*c* may be hermetically sealed by the main bearing 131 and the sub bearing 132. The back pressure chambers 1342*a*, 1342*b*, and 1342*c* may independently communicate with the back pressure pockets 1313 and 1323, or the plurality of back pressure chambers 1342*a*, 1342*b*, and 1342*c* may be formed to communicate together through the back pressure pockets 1313 and 1323.

The back pressure pockets 1313 and 1323 may be formed at the flange portion 1321 of the main bearing 131 and the flange portion 1322 of the sub bearing 132, respectively, as shown in FIG. 1. In some cases, however, they may be formed in one bearing, either the main bearing 131 or the sub bearing 132. In this embodiment, the back pressure pockets 1313 and 1323 are formed in both the main bearing 131 and the sub bearing 132. For convenience of explanation, the back pressure pocket formed in the main bearing is referred to as a main-side back pressure pocket 1313, and the back pressure pocket formed in the sub bearing 132 is referred to as a sub-side back pressure pocket 1323.

As described above, the main-side back pressure pocket 1313 is provided with the main-side first pocket 1313*a* and the main-side second pocket 1313*b*, and the sub-side back pressure pocket 1323 is provided with the sub-side first pocket 1323*a* and the sub-side second pocket 1323*b*. Also, the second pockets of both the main-side and the sub-side form a higher pressure compared to the first pockets. Accordingly, the main-side first pocket 1313*a* and the sub-side first pocket 1323*a* communicate with a back pressure chamber of a vane located relatively at an upstream side (in a suction stroke until before a discharge stroke) among those vanes, and the main-side second pocket 1313*b* and the sub-side second pocket 1323*b* communicate with a back pressure chamber of a vane located relatively at a downstream side (in the discharge stroke until before the suction stroke) among those vanes.

As for the vanes 1351, 1352, and 1353, if a vane located most adjacent to the contact point P1 in a compression proceeding direction is defined as a first vane 1351, and the other vanes are sequentially defined as a second vane 1352 and a third vane 1353 from the contact point P1, the first vane 1351, the second vane 1352, and the third vane 1353 are spaced apart from one another by a same circumferential angle. Accordingly, when a compression chamber formed between the first vane 1351 and the second vane 1352 is a first compression chamber V1, a compression chamber formed between the second vane 1352 and the third vane 1353 is a second compression chamber V2, and a compression chamber formed between the third vane 1353 and the first vane 1351 is a third compression chamber V3, all of the compression chambers V1, V2, and V3 have a same volume at a same crank angle.

The vanes 1351, 1352, and 1353 may be formed in a substantially rectangular parallelepiped shape of end surfaces of the vane in a lengthwise direction of the vane, a surface in contact with the inner circumferential surface 133*a* of the cylinder 133 is defined as a front surface of the vane, and a surface facing the back pressure chamber 1342*a*, 1342*b*, 1342*c* is defined as a rear surface of the vane. The front surface of each of the vanes 1351, 1352, and 1353 is curved so as to be in line contact with the inner circumferential surface 133*a* of the cylinder 133, and the rear surface of the vane 1351, 1352 and 1353 is formed flat to be inserted into the back pressure chamber 1342*a*, 1342*b*, 1342*c* to evenly receive back pressure.

In the drawings, unexplained reference numerals 110*b* and 110*c* denote an upper shell and a lower shell, receptively.

In the vane rotary compressor according to the embodiment, when power is applied to the drive motor 120 so that the rotor 122 of the drive motor 120 and the rotational shaft 123 coupled to the rotor 122 rotate together, the roller 134 rotates together with the rotational shaft 123. Then, the vanes 1351, 1352 and 1353 are pulled out from the respective vane slots 1341*a*, 1341*b*, and 1341*c* by a centrifugal force generated due to rotation of the roller 134 and back pressure of the back pressure chambers 1342*a*, 1342*b*, and 1342*c* provided at the rear side of the vanes 1351, 1352, and 1353. Accordingly, the front-end surface of each of the vanes 1351, 1352, and 1353 is brought into contact with the inner circumferential surface 133*a* of the cylinder 133.

The compression space V of the cylinder 133 is divided by the plurality of vanes 1351, 1352, and 1353 into a plurality of compression chambers (including a suction chamber or a discharge chamber) V1, V2, and V3 as many as the number of vanes 1351, 1352 and 1353. A volume of each compression chamber V1, V2, and V3 changes according to a shape of the inner circumferential surface 133*a* of the cylinder 133 and eccentricity of the roller 134 while moving in response to the rotation of the roller 134. A refrigerant filled in each of the compression chambers V1, V2, and V3 then flows along the roller 134 and the vanes 1351, 1352, and 1353 so as to be suctioned, compressed, and discharged.

This will be described further as follows. FIGS. 4A-4D are cross-sectional views illustrating processes of suctioning, compressing, and discharging a refrigerant in a cylinder according to an embodiment. In FIG. 4A to FIG. 4D, the main bearing is shown. The sub bearing not shown is the same as the main bearing.

Figure 4A:
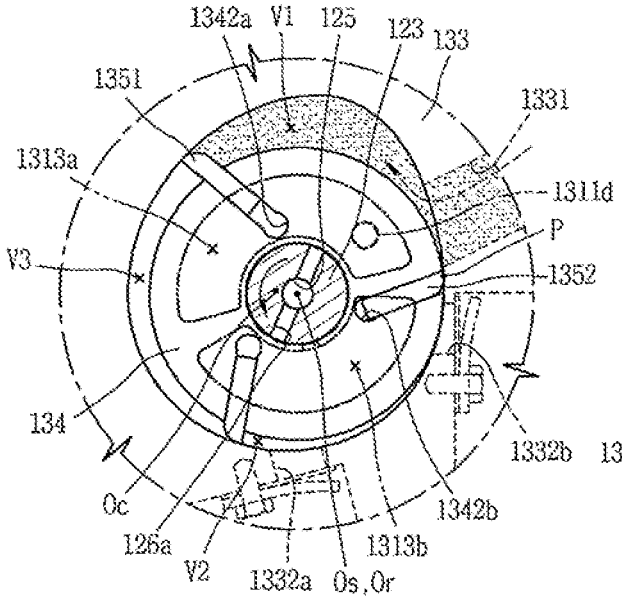
FIGS. 4A-4D are sectional views illustrating processes of suctioning, compressing, and discharging a refrigerant in a cylinder according to an embodiment.

As illustrated in FIG. 4A, the volume of the first compression chamber V1 continuously increases until before the first vane 1351 passes through the inlet port 1331 and the second vane 1352 reaches a suction completion time, so that a refrigerant is continuously introduced into the first compression chamber V1 through the inlet port 1331. At this time, the first back pressure chamber 1342*a* provided at the rear side of the first vane 1351 is exposed to the first pocket 1313*a* of the main-side back pressure pocket 1313, and the second back pressure chamber 1342*b* provided at the rear side of the second vane 1352 is exposed to the second pocket 1313*b* of the main-side back pressure pocket 1313. Accordingly, the first back pressure chamber 1342*a* forms an intermediate pressure and the second back pressure chamber 1342*b* forms discharge pressure or a pressure almost equal to the discharge pressure (hereinafter, referred to as "discharge pressure"). The first vane 1351 is pressed by the intermediate pressure and the second vane 1352 is pressed by the discharge pressure, respectively, to be brought into close contact with the inner circumferential surface of the cylinder 133.

Figure 4B:
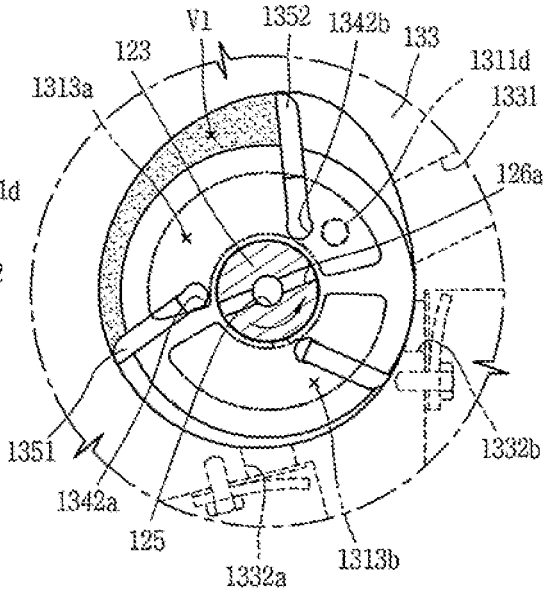

As illustrated in FIG. 4B, when the second vane 1352 starts a compression stroke after passing the suction completion time (or the compression start angle), the first compression chamber V1 is hermetically sealed and moves in a direction toward the outlet port together with the roller 134. During this process, the volume of the first compression chamber V1 is continuously decreased and accordingly a refrigerant in the first compression chamber V1 is gradually compressed.

At this time, when the refrigerant pressure in the first compression chamber V1 rises, the first vane 1351 may be pushed toward the first back pressure chamber 1342*a*. As a result, the first compression chamber V1 communicates with the preceding third chamber V3, which may cause refrigerant leakage. Therefore, a higher back pressure needs to be formed in the first back pressure chamber 1342*a* in order to prevent refrigerant leakage.

Referring to the drawings, the back pressure chamber 1342*a* is about to enter the main-side second pocket 1313*b* after passing the main-side first pocket 1313*a*. Accordingly, the back pressure formed in the first back pressure chamber 1342*a* immediately rises to the discharge pressure from the intermediate pressure. As the back pressure of the first back pressure chamber 1342*a* increases, it is possible to suppress the first vane 1351 from being pushed backwards.

Figure 4C:
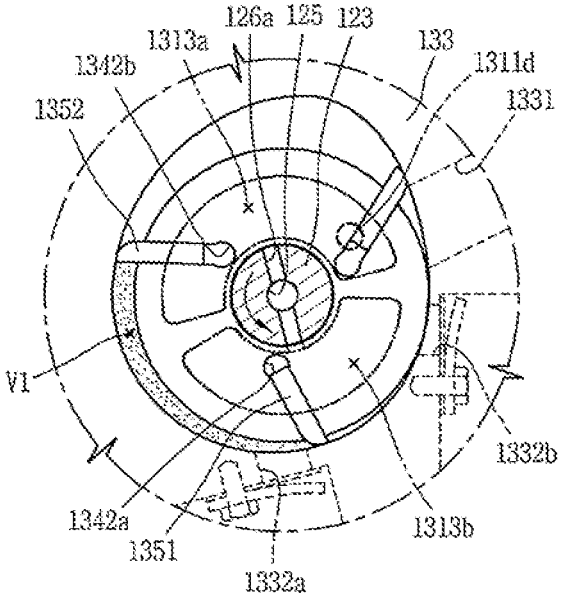

As illustrated in FIG. 4C, when the first vane 1351 passes through the first outlet port 1332*a* and the second vane 1352 has not reached the first outlet port 1332*a*, the first compression chamber V1 communicates with the first outlet port 1332*b* and the second outlet port 1332*b* is opened by pressure of the first compression chamber V1. Then, a portion of refrigerant in the first compression chamber V1 is discharged to the inner space of the casing 110 through the first outlet port 1332*a*, so that the pressure of the first compression chamber V1 is lowered to a predetermined pressure. In the case where the first outlet port 1332*a* is not formed, a refrigerant in the first compression chamber V1 further moves toward the second outlet port 1332*b*, which is the main outlet port, without being discharged from the first compression chamber V1.

At this time, the volume of the first compression chamber V1 is further decreased so that the refrigerant in the first compression chamber V1 is further compressed. However, the first back pressure chamber 1342*a* in which the first vane 1351 is accommodated completely communicates with the main-side second pocket 1313*b* so as to form pressure almost equal to the discharge pressure. Accordingly, the first vane 1351 is not pushed by the back pressure of the first back pressure chamber 1342*a*, thereby suppressing leakage between the compression chambers.

Figure 4D:
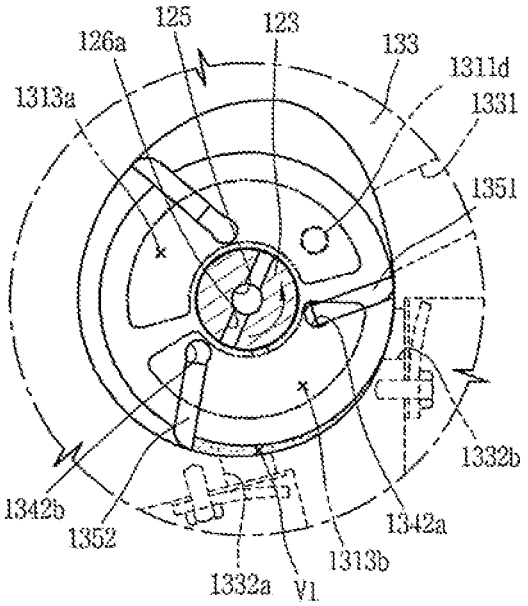

As illustrated in FIG. 4D, when the first vane 1351 passes through the second outlet part 1332*b* and the second vane 1352 reaches a discharge start angle, the second outlet port 1332*b* is opened by refrigerant pressure of the first compression chamber V1. Then, the refrigerant in the first compression chamber V1 is discharged to the inner space of the casing 110 through the second outlet port 1332*b*.

At this time, the back pressure chamber 1342*a* of the first vane 1351 is about to enter the main-side first pocket 1313*a* as an intermediate pressure region after passing the main-side second pocket 1313*b* as a discharge pressure region. Accordingly, back pressure formed in the back pressure chamber 1342*a* of the first vane 1351 is lowered to the intermediate pressure from the discharge pressure.

The back pressure chamber 1342*b* may be located in the main-side second pocket 1313*b*, which is the discharge pressure region, and back pressure corresponding to discharge pressure may be formed in the second back pressure chamber 1342*b*.

Figure 5:
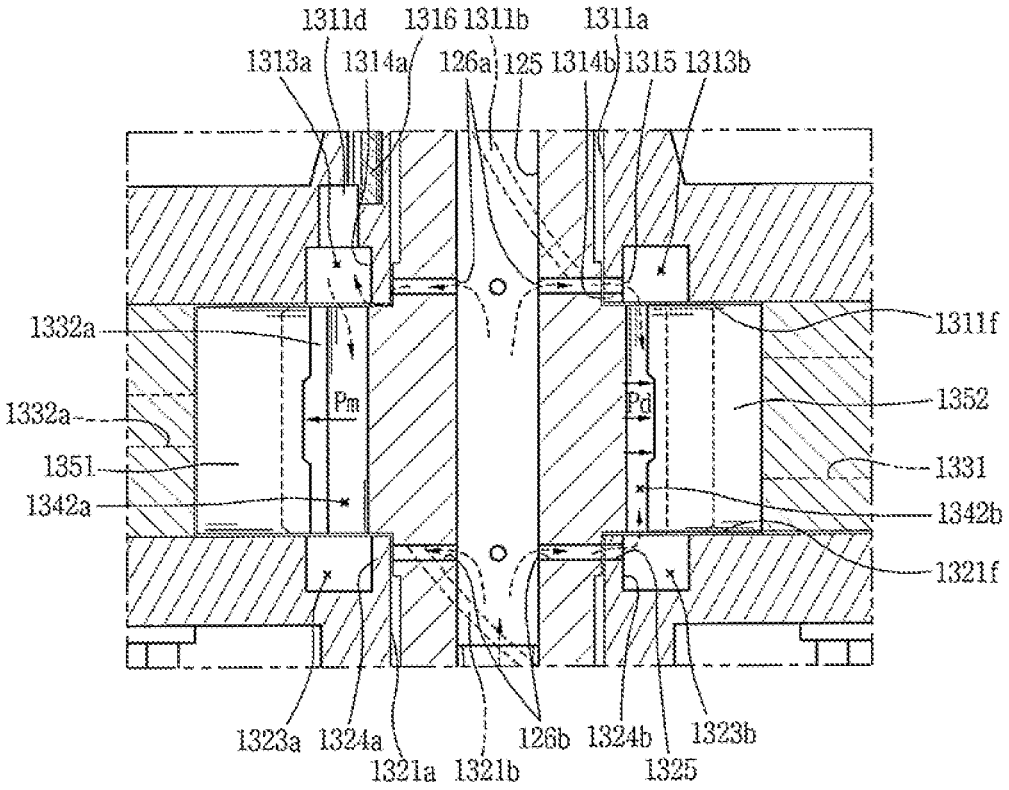
FIG. 5 is a cross-sectional view of a compression unit for explaining back pressure of each back pressure chamber in the vane rotary compressor according to an embodiment.

FIG. 5 is a longitudinal sectional view of a compression unit for explaining back pressure of each back pressure chamber in the vane rotary compressor according to an embodiment.

Referring to FIG. 5, the intermediate pressure Pm between the suction pressure and the discharge pressure is formed at the rear end portion of the first vane 1351 located in the main-side first pocket 1313*a*, and the discharge pressure Pd (actually, a pressure slightly lower than the discharge pressure) is formed in the rear end portion of the second vane 1352 located in the second pocket 1313*b*. In particular, as the main-side second pocket 1313*b* directly communicates with the oil flow path 125 through the first oil passage hole 126*a* and the first communication flow path 1315, the pressure of the second back pressure chamber 1342*b* communicating with the main-side second pocket 1313*b* may be prevented from rising above the discharge pressure Pd.

Accordingly, the intermediate pressure Pm, which is much lower than the discharge pressure Pd, is formed in the main-side first pocket 1313*a*, and thus, mechanical efficiency between the cylinder 133 and the first vane 1351 may be enhanced. Also, the discharge pressure Pd or a pressure slightly lower than the discharge pressure Pd may be formed in the main-side second pocket 1313*b*, and thus, the second vane 1352 appropriately comes in close contact with the cylinder 133, thereby suppressing leakage between compression chambers and enhancing mechanical efficiency.

The first pocket 1313*a* and the second pocket 1313*b* of the main-side back pressure pocket 1313 according to the embodiment communicate with the oil flow path 125 via the first oil passage hole 126*a*, and the first pocket 1323*a*, and the second pocket 1323*b* of the sub-side back pressure pocket 1323 communicate with the oil flow path 125 via the second oil passage hole 126*b*.

Referring back to FIGS. 2 and 3, the main-side first pocket 1313*a* and the sub-side first pocket 1323*a* are closed by the main-side and sub-side first bearing protrusions 1314*a* and 1324*a* with respect to the bearing surfaces 1311*a* and 1321*a* that the main-side and sub-side first pockets 1313*a* and 1323*a* face, respectively. Accordingly, oil (refrigerant mixed with oil) in the main-side and sub-side first pockets 1313*a* and 1323*a* flows into the bearing surfaces 1311*a* and 1321*a* through the respective oil passage holes 126*a* and 126*b*, and is decompressed while passing through a gap between the main-side and sub-side first bearing protrusions 1314*a* and 1324*a* and the opposite upper surface 134*a* or lower surface 134*b* of the roller 134, resulting in forming the intermediate pressure.

On the other hand, the main-side and sub-side second pockets 1313*b* and 1323*b* communicate with the respective bearing surfaces 1311*a* and 1321*a*, which the second pockets face, by the main-side and sub-side second bearing protrusions 1314*b* and 1324*b*. Accordingly, oil (refrigerant mixed with oil) in the main-side and sub-side second pockets 1313*b* and 1323*b* flows into the bearing surfaces 1311*a* and 1321*a* through the respective oil passage holes 126*a* and 126*b*, and is introduced into the respective second pockets 1313*b* and 1323*b* via the main-side and sub-side bearing protrusions 1314*b* and 1324*b*, thereby forming pressure equal to or slightly lower than the discharge pressure.

However, in the embodiment, the main-side second pocket 1313*b* and the sub-side second pocket 1323*b* may communicate in a fully opened state, or communicate in a non-fully opened state with the bearing surfaces 1311*a* and 1321*a*, which the pockets face, respectively. The latter will be described first. In other words, the main-side second bearing protrusion 1314*b* and the sub-side second bearing protrusion 1324*b* mostly block the main-side second pocket 1313*b* and the sub-side second pocket 1323*b*, however, partially block the respective second pockets 1313*b* and 1323*b* with the communication flow paths 1315 and 1325 interposed therebetween.

During operation of the compressor, the main-side and sub-side first bearing protrusions 1314*a* and 1324*a* come in close contact with the upper surface 134*a* or the lower surface 134*b* of the roller 134, which the first bearing protrusions face, respectively. As a result, oil may not be smoothly supplied to the main-side and sub-side first pockets 1313*a* and 1323*a*. Then an insufficient amount of oil may be supplied to the main-side and sub-side first pockets 1313*a* and 1323*a* in a specific range based on a rotational direction of the roller 134. Accordingly, oil with a medium pressure is not smoothly supplied to each of the back pressure chambers 1342*a*, 1342*b*, and 1342*c* in the specific range, and thus, the ear side of the respective vanes may not be properly supported. Then the front surface of the respective vanes may be detached from the inner circumferential surface 133*a* of the cylinder 133, which may cause refrigerant leakage between compression chambers, or a further increase in vibration of the vanes, resulting in compressor noise or abrasion. In addition, friction loss or abrasion due to insufficient oil may occur in the corresponding range. Further, as the pressure in each of the back pressure chambers 1342*a*, 1342*b*, and 1342*c* is not constantly maintained, vane vibration, as mentioned earlier, may be further increased.

Therefore, in embodiments disclosed herein, at least one of the main bearing or the sub bearing is provided with an oil supply passage and/or oil guide passage for communicating a space between the outer circumferential surface of the rotational shaft and the inner circumferential surface of the main bearing with the back pressure pocket of the main bearing, or a space between the outer circumferential surface of the rotational shaft and the inner circumferential surface of the sub bearing with the back pressure pocket of the sub bearing. The oil supply passage and/or oil guide passage may communicate with the back pressure pocket having a relatively low pressure among the plurality of back pressure pockets. Accordingly, oil may be smoothly supplied to the main-side and sub-side first pockets 1313*a* and 1323*a* forming the intermediate pressure.

The oil supply passage and/or oil guide passage may be formed in any one of the main bearing or the sub bearing as described above. However, in this embodiment, the vane rotary compressor is installed vertically, and thus, description will be given focusing on an example in which the oil supply passage and/or oil guide passage is formed in the main bearing.

Figure 6:
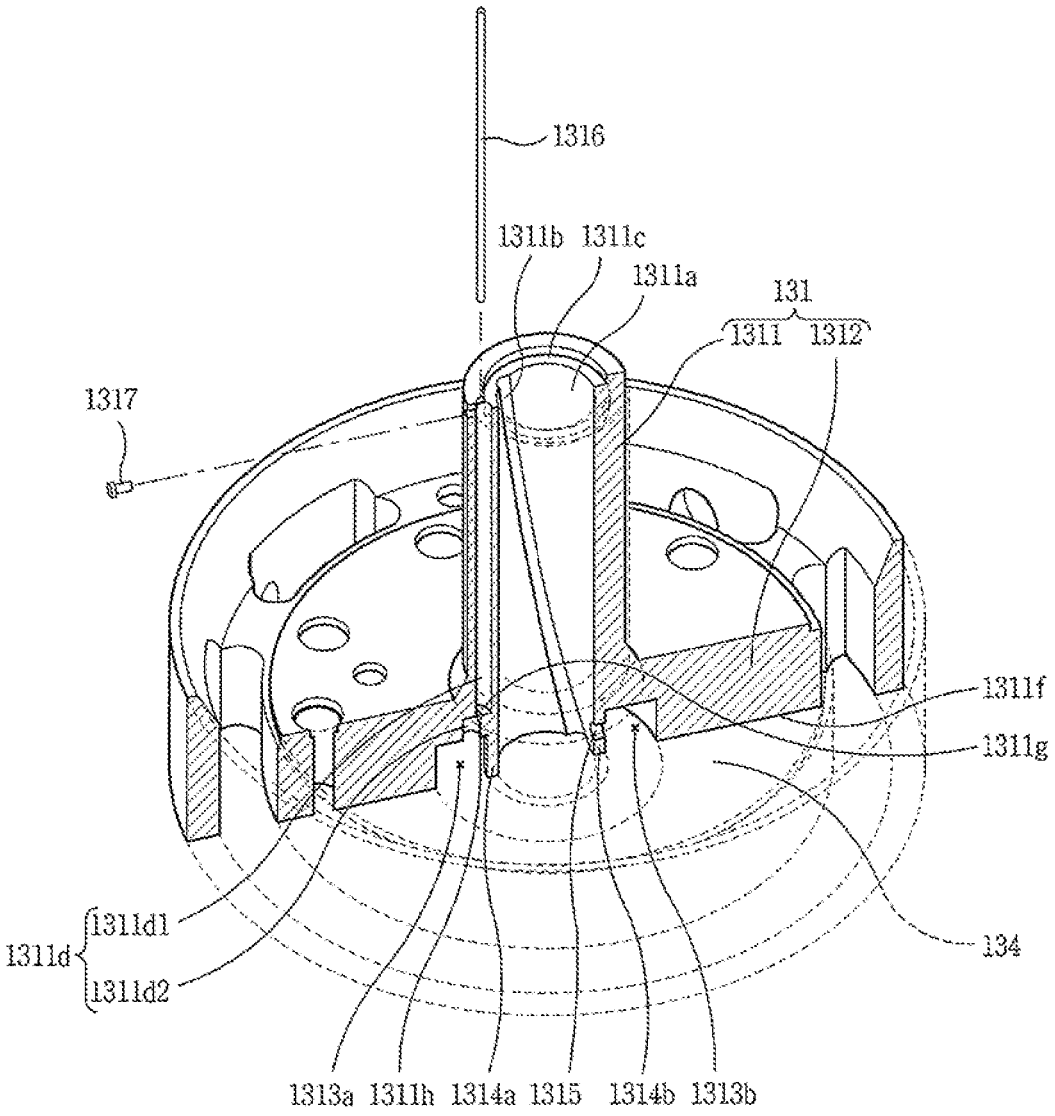
FIG. 6 is a disassembled perspective view of a main bearing in the vane rotary compressor according to an embodiment.
Figure 7:
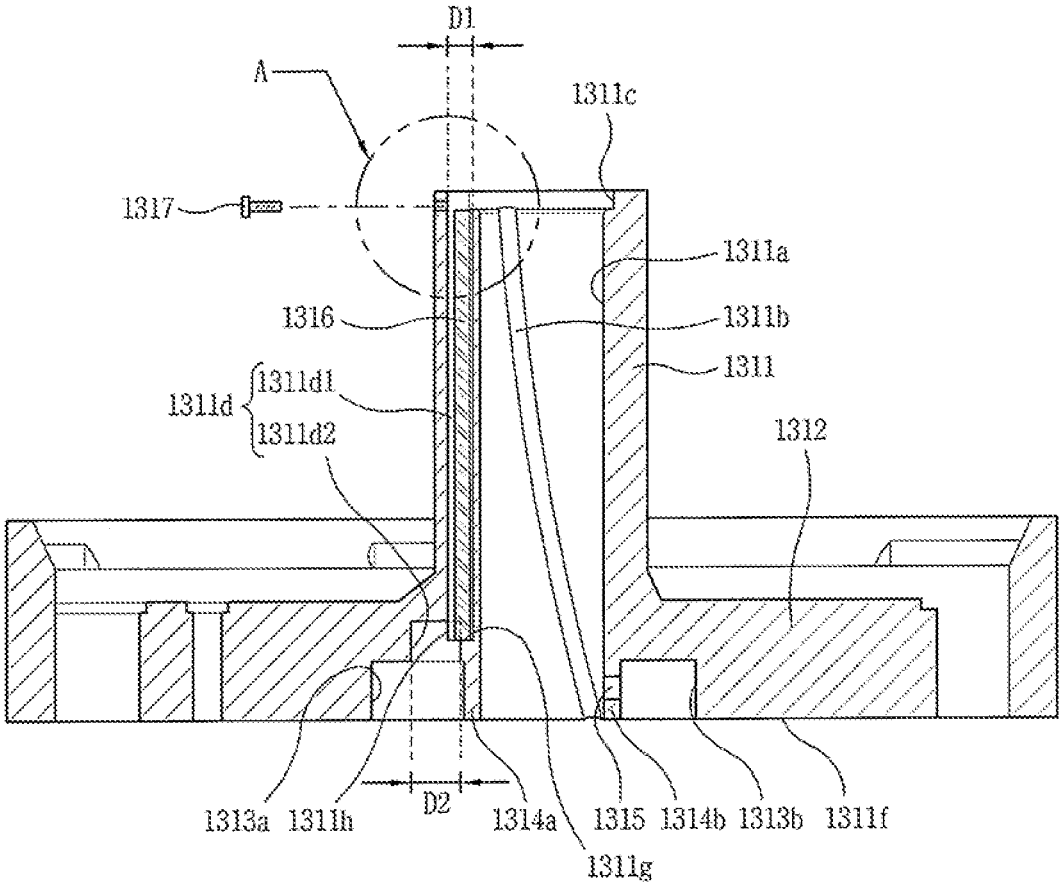
FIG. 7 is a cross-sectional view of the main bearing of FIG. 6, viewed from a frontward direction.
Figure 8:
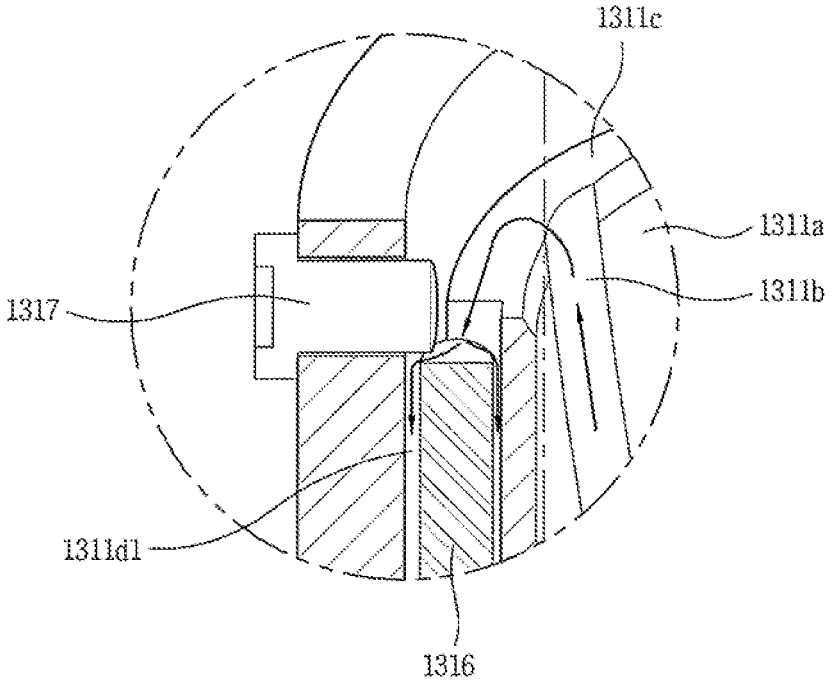
FIGS. 8 to 9 are enlarged perspective views illustrating a portion "A" of FIG. 7.
Figure 9:
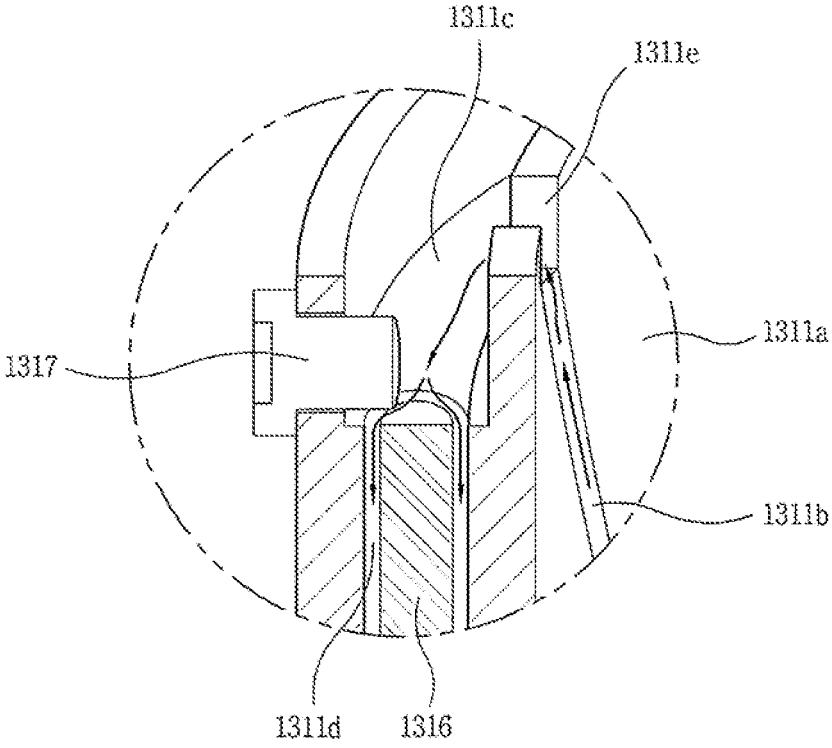
Figure 10:
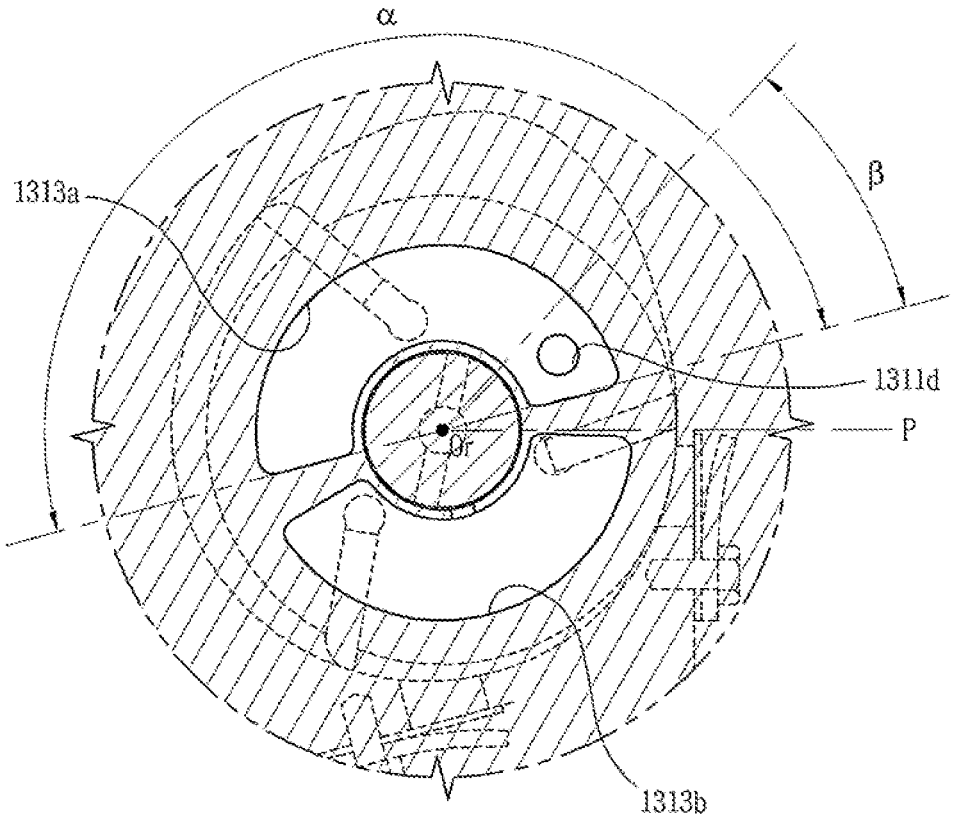
FIG. 10 is a schematic view illustrating a position of an oil supply passage in the vane rotary compressor according to an embodiment.
Figure 11:
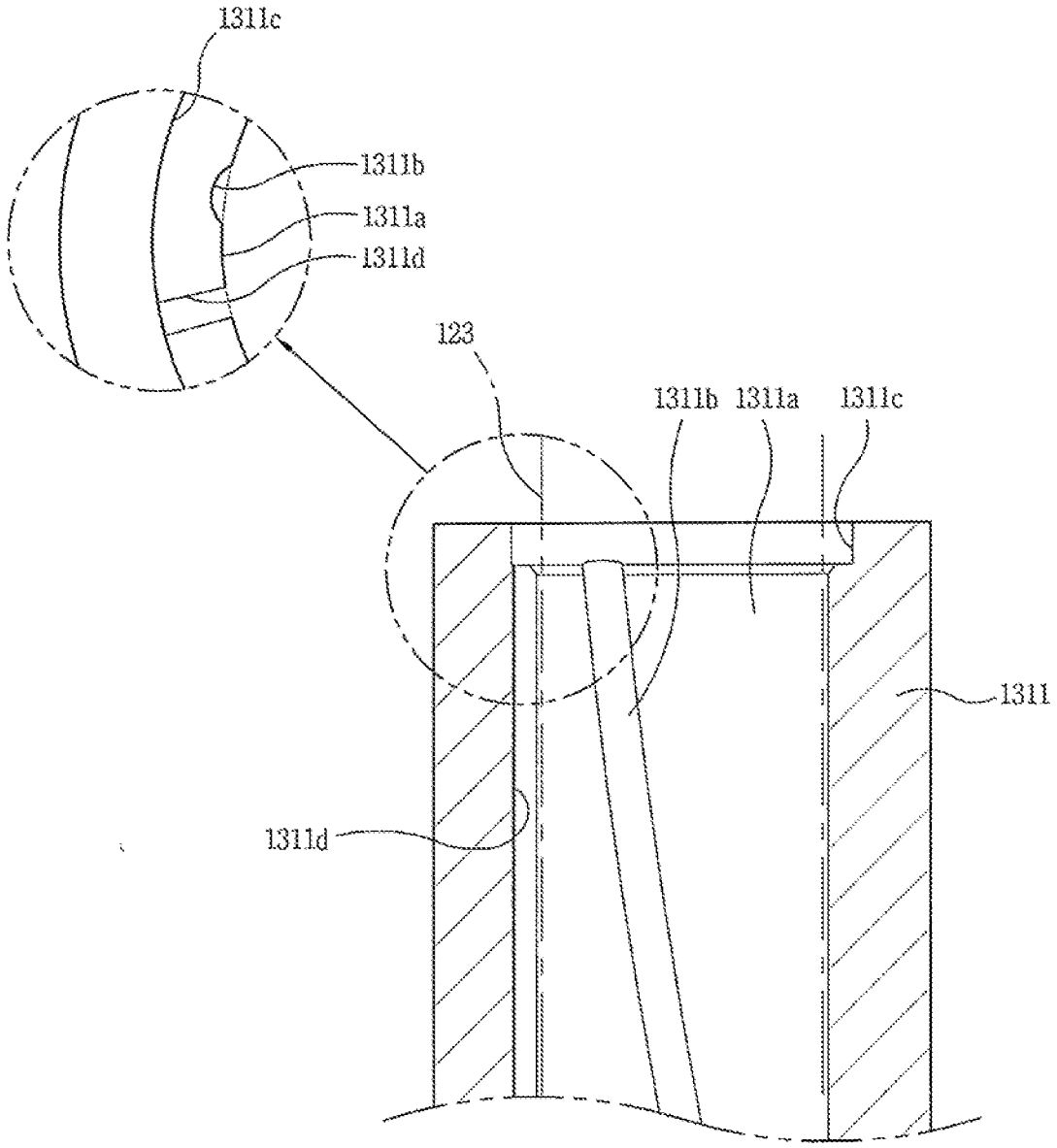
FIG. 11 is a cross-sectional view illustrating another example of an oil supply passage in the vane rotary compressor according to an embodiment.

FIG. 6 is a disassembled perspective view of a main bearing in a vane rotary compressor according to an embodiment. FIG. 7 is a cross-sectional view of the main bearing of FIG. 6, viewed from a frontward direction, FIGS. 8 to 9 are enlarged perspective views of portion "A" of FIG. 7. FIG. 10 is a schematic view illustrating a position of an oil supply passage in the vane rotary compressor according to an embodiment. FIG. 11 is a cross-sectional view illustrating another example of an oil supply passage in the vane rotary compressor according to an embodiment.

Referring to FIGS. 6 and 7, the main bearing 131 according to an embodiment is configured as a boss portion (hereinafter, "first boss portion") 1311, and a flange portion (hereinafter, "first flange portion") 1312 radially extending from an outer circumferential surface of a lower end of the first boss portion 1311. Accordingly, the first boss portion 1311 is formed to extend from an upper surface of the first flange portion 1312 by a predetermined height.

A radial bearing surface may be formed on an inner circumferential surface of the first boss portion 1311, and the first oil groove 1311*b* may be diagonally provided in the radial bearing surface. The first oil groove 1311*b* may be formed axially over an entire part or portion of the first boss portion 1311 or may be formed only in a middle part or portion of the first boss portion 1311. Either way is possible if the first oil groove 1311 communicates with the first oil passage hole 126*a* of the rotational shaft.

The oil accommodating groove 1311*c* may be formed on the end surface of the first boss portion 1311, and the inner circumferential surface of the oil accommodating groove 1311*c* may communicate with the first oil groove 1311*b*. The oil accommodating groove 1311*c* may be formed in an annular shape having a predetermined depth. In addition, the oil accommodating groove 1311*c* may be formed as deep as possible by taking the radial bearing surface of the main bearing, that is, the main-side first bearing surface 1311*a* into consideration.

Thus, the oil accommodating groove 1311*c* may communicate with the inner circumferential surface of the first boss portion 1311 as shown in FIG. 8. Alternatively, as shown in FIG. 9, the oil accommodating groove 1311*c* may be radially formed in a middle of the end surface of the first boss portion 1311, which allows the oil accommodating groove 1311*c* to have a deeper depth and a height of the main-side first bearing surface 1311*a* to be secured. In this case, however, an oil communication groove 1311*e* may be formed by opening a portion of the inner circumferential surface of the oil accommodating groove 1311*c*, so that the first oil groove 1311*b* communicates with the oil accommodating groove 1311*c*.

In addition, the oil accommodating groove 1311*c* may have a large outer diameter in order to secure as large a volume as possible, for example, approximately 1.2 to 1.4 times the radial bearing surface. That is, the main-side first bearing surface 1311*a* may be appropriate for achieving reliability of the main bearing.

The oil supply hole 1311*d*, which is the oil supply passage, may be formed to communicate with one side of the oil accommodating groove 1311*c* in the circumferential direction. The oil supply hole 1311*d* may be formed to communicate with the outer circumferential surface of the oil accommodating groove 1311*c*. The oil supply hole 1311*d* may communicate with the maim-side first pocket 1313*a*, as described above, by penetrating in the axial direction.

The oil supply hole 1311*d* may be formed as one hole. However, when the oil supply hole 1311*d* is configured as one hole, a pressure reducing (or relief) pin to be inserted into the oil supply hole 1311*d* may not be easily fixed to its normal position. Accordingly, forming a plurality of holes in an eccentric manner may be more desirable for the oil supply hole 1311*d*.

For example, as shown in FIG. 7, the oil supply hole 1311*d* may be configured as a first oil supply hole 1311*d*1 forming a first oil supply passage and communicating with the oil accommodating groove 1311*c*, and a second oil supply hole 1311*d*2 forming a second oil supply passage and extending from the first oil supply hole 1311*d*1 so as to communicate with an upper wall surface of the main-side first pocket 1313*a*. An axial center of the first oil supply hole 1311*d*1 and an axial center of the second oil supply hole 1311*d*2 may be eccentrically formed with respect to each other. Accordingly, at least a portion of a lower end of the first oil supply hole 1311*d*1 and an upper end of the second oil supply hole 1311*d*2 may be formed to axially and radially overlap with each other, thereby securing an oil communication hole 1311*h* between the first oil supply hole 1311*d*1 and the second oil supply hole 1311*d*2.

A stepped surface 1311*g* may be formed between the first oil supply hole 1311*d*1 and the second oil supply hole 1311*d*2. A lower end of the pressure reducing pin 1316 to be inserted into the first oil supply hole 1311*d*1 may be axially supported on the stepped surface 1311*g*.

An inner diameter D2 of the second oil supply hole 1311*d*2 may be larger than an inner diameter D1 of the first oil supply hole 1311*d*1 in order to smoothly supply oil to the main-side first pocket 1313*a*. In some cases, however, the inner diameter of the first oil supply hole 1311*d*1 and the inner diameter of the second oil supply hole 1311*d*2 may be formed to be the same, or the inner diameter of the second oil supply hole 1311*d*2 may be formed to be smaller than the inner diameter hole of the first oil supply hole 1311*d*1. In these cases, the axial center of the first oil supply hole 1311*d*1 and the axial center of the second oil supply hole 1311*d*2 may be eccentrically formed so as not to coincide with each other.

As described above, the pressure reducing pin 1316 may be inserted into the first oil supply hole 1311*d*1. One or a first end of the pressure reducing pin 1316 may be in close contact with the upper end of the second oil supply hole 1311*d*2, that is, a supporting surface, so as to be supported downward in the axial direction while another or a second end thereof may be supported upward in the axial direction by a fixing pin 1317 radially penetrating the first boss portion 1311. An outer diameter of the pressure reducing pin 1316 may be formed to be smaller than the inner diameter of the first oil supply hole 1311*d*1.

In addition, as shown in FIG. 10, based on the rotational direction of the roller 134, an outlet (or exit) end of the second oil supply hole 1311*d*2 may be eccentrically formed from n intermediate position in a circumferential direction of the first main-side pocket 1313*a*, toward a contact point P which is a relatively suction side. In other words, if a circumferential angle between opposite ends of the main-side first pocket is $\alpha$, and a circumferential angle from the end of the main-side first pocket at the contact point side to the outlet end of the second oil supply hole 1311*d*2 is $\beta$, then the $\beta$ is formed to be ½ or less of $\alpha$. Accordingly, oil flowing into the suction side of the main-side first pocket 1313*a* through the second oil supply hole 1311*d*2 spreads out and flows according to the rotation of the roller 134, evenly lubricating an upper surface (not shown) or a lower surface (not shown) of the roller 134 and their contact surfaces with an axial bearing surface of the main bearing 131 and an axial bearing surface of the sub bearing 132 (hereinafter referred to as "main-side second bearing surface" and "sub-side second bearing surface", respectively) [1311*f*, 1321*f*].

The oil supply passage 1311*d* may be formed in a groove shape having a predetermined area on the main-side first bearing surface 1311*a*, as shown in FIG. 11. The oil supply passage 1311*d* may be formed in a shape similar to a shape of the first oil groove 1311*b*. However, in order to communicate with the main-side first pocket 1313*a*, the oil supply passage 1311*d* may be formed as a slit having a predetermined depth in the radial direction.

In the vane rotary compressor according to embodiments, oil filled in the inner space of the casing 110 is pumped by the oil feeder 127 provided at a lower end of the rotational shaft, and is then introduced into the space between the main bearing 131 and the rotational shaft 123 or the space between the sub-bearing 132 and the rotational shaft 123 via the oil flow path 125 of the rotational shaft 123 and the oil passage holes 126*a* and 126*b*. A portion of the oil may flow into the main-side first pocket 1313*a* and the sub-side first pocket 1323*a* as described above, and another portion of the oil may be introduced into the main-side second pocket 1313*b* and the sub-side second pocket 1323*b*. The oil introduced into each of the pockets may flow into the respective back pressure chambers, so as to press the vanes 1351, 1352, and 1353 in a direction toward the cylinder 133 as the roller 134 rotates.

Even if an inner side of the main-side second pocket 1313*b* and the sub-side second pocket 1323*b* are blocked by the respective bearing protrusions 1314*b* and 1324*b*, the communication flow path 1315, 1325 may be formed at the bearing protrusions 1314*b* and 1324*b*, respectively, and thus, oil may be smoothly introduced into the respective second pockets 1313*b* and 1323*b*. As the main-side second pocket 1313*b* and the sub-side second pocket 1323*b* should form the discharge pressure or a pressure similar to the discharge pressure, an inner diameter of the communication flow path 1315, 1325 should be formed as large as possible. Accordingly, a sufficient amount of oil may flow through the second pockets 1313*b* and 1323*b* as oil smoothly flows into the respective bearing protrusions 1314*b* and 1324*b*.

However, the main-side first pocket 1313*a* and the sub-side first pocket 1323*a* should form the intermediate pressure higher than the suction pressure but lower than the discharge pressure. Accordingly, unlike the second bearing protrusions 1314*b* and 1324*b*, a communication flow path may not be formed at the first bearing protrusions 1314*a* and 1324*a*. Therefore, in the related art, oil is introduced into the respective first pockets 1313*a* and 1323*a* through a narrow gap between the first bearing protrusion 1314*a* and the upper or lower surface of the roller 134, and a narrow gap between the first bearing protrusion 1324*a* and the upper or lower surface of the roller 134. As a result, oil is hardly introduced into the first pockets or only a slight amount of oil is introduced into the first pockets, depending on an operating condition of the compressor. Then as described above, oil in the first pockets 1313*a* and 1323*a*, and the back pressure chambers 1342*a*, 1342*b*, and 1342*c* becomes insufficient. As a result, each of the vanes may not be properly pushed or insufficient lubrication may occur.

Figure 12:
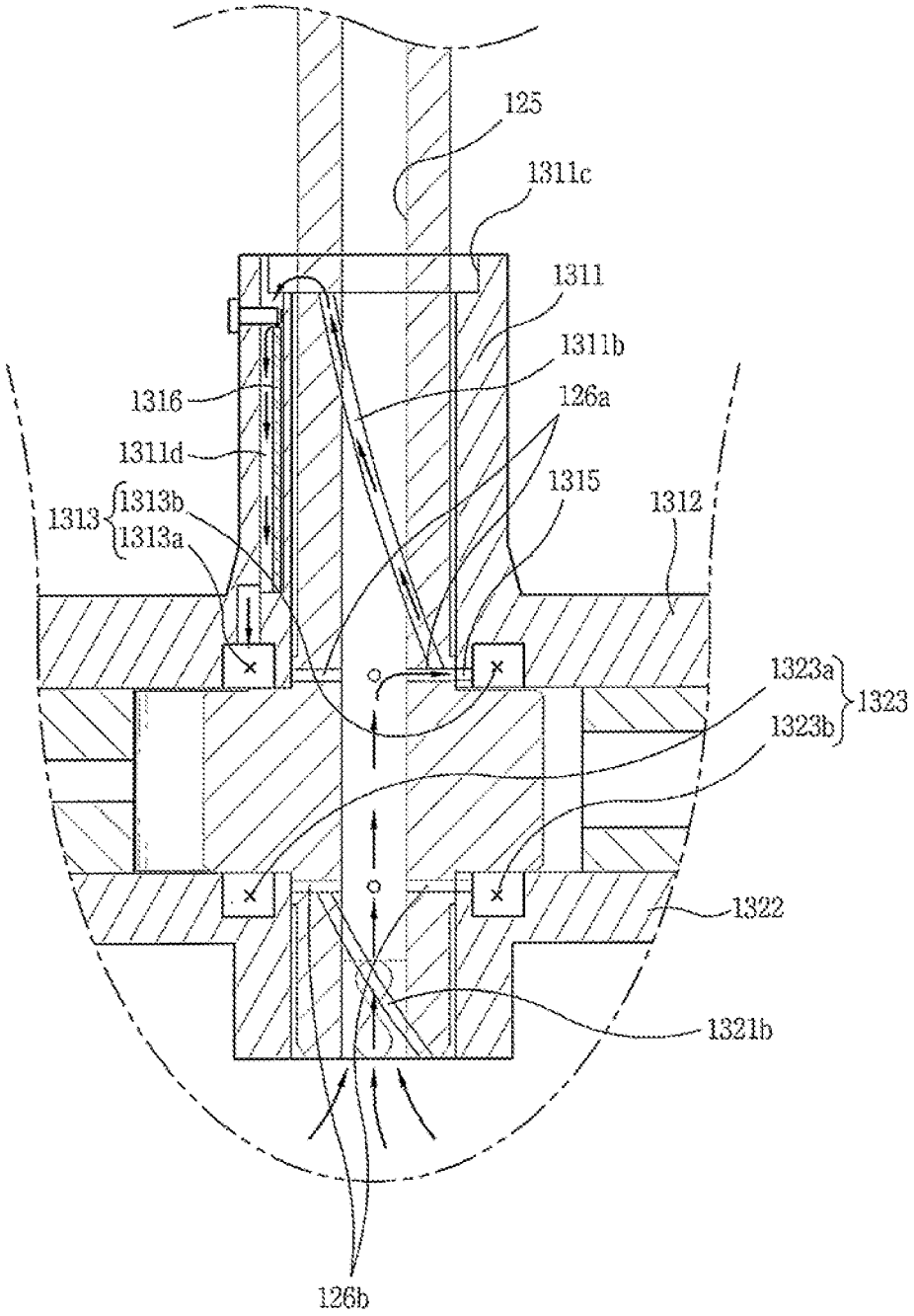
FIG. 12 is a cross-sectional view illustrating a process of supplying oil to a back pressure pocket in the vane rotary compressor according to an embodiment.

Therefore, in embodiments disclosed herein, as illustrated in FIG. 12, the first oil groove 1311*b* may be formed on the main-side first bearing surface 1311*a*, which is the inner circumferential surface of the first boss portion 1311 of the main bearing 131, the oil accommodating groove 1311*c* may be formed on an upper end of the first boss portion 1311, and the oil supply hole 1311*d* may be formed in the first boss portion 1311 in a communicating manner. This allows oil introduced into a space between the inner circumferential surface of the first boss portion 1311 and the outer circumferential surface of the rotational shaft 123 via the oil flow path 125 of the rotational shaft 123 and the first oil passage 126*a* to flow into the main-side first pocket 1313*a* through the first oil groove 1311*b*, the oil accommodating groove 1311*c*, and the oil supply hole 1311*d*. Then, even if oil is not smoothly supplied to the main-side first pocket 1313*a* through the narrow gap between the main-side first bearing protrusion 1314*a* and the upper surface of the roller 134 depending on an operating condition, oil may be smoothly supplied to the main-side first pocket 1313*a* through the oil supply hole 1311*d*. The pressure reducing pin 1316 may be inserted into the oil supply hole 1311*d*, so that oil flowing into the oil supply hole 1311*d* is reduced to the appropriate intermediate pressure.

By doing so, the front surface of the vane is not separated from the inner circumferential surface of the cylinder, or friction loss between the roller and the main bearing or the sub bearing caused by insufficient oil in the first pocket may be suppressed. In addition, as the oil supply hole is formed in one member like the main bearing, the oil supply hole may be formed more easily and accurately than when forming the oil supply hole in a plurality of members.

Hereinafter, description will be given of another example of an oil supply passage in the vane rotary compressor according to an embodiment. In the previous embodiment, the oil supply hole 1311*d* is formed through the first boss portion 1311 of the main bearing, but in this embodiment, the oil supply hole is formed through the cylinder and the main bearing.

Figure 13:
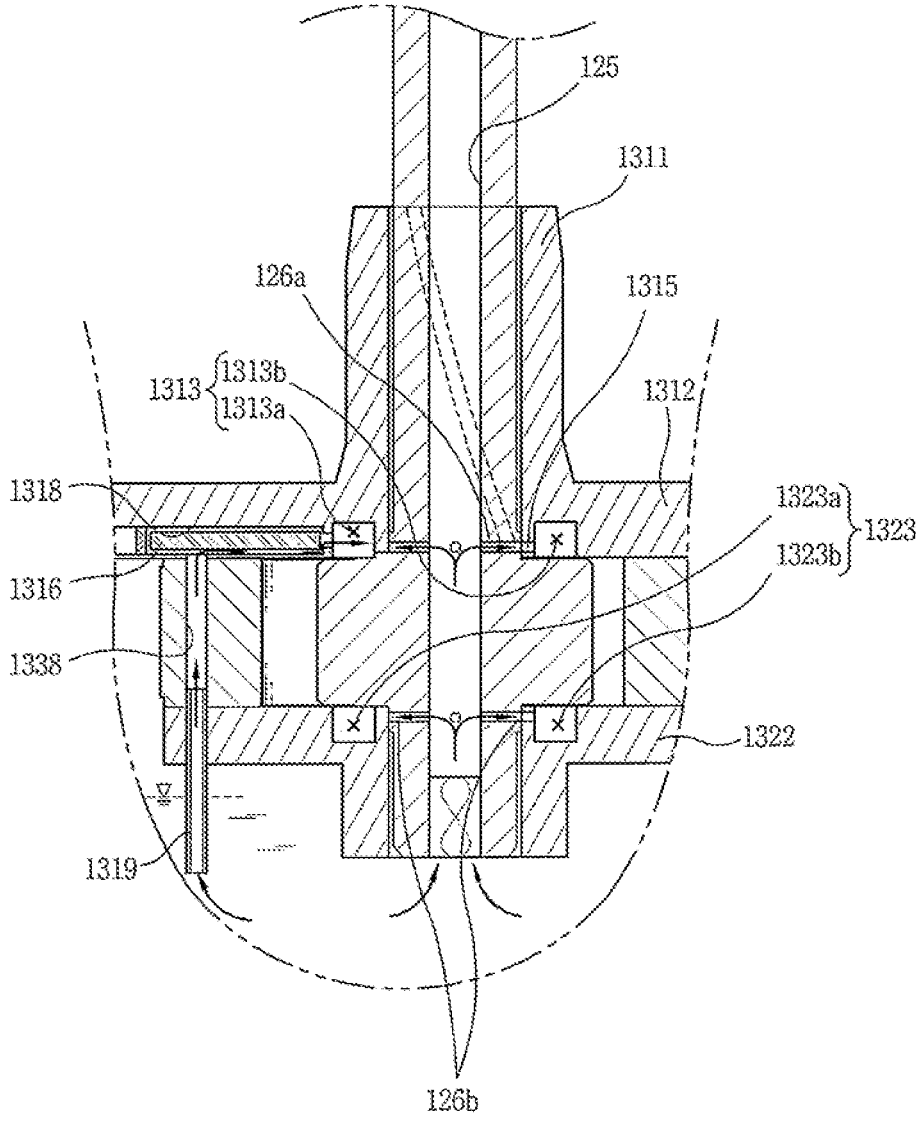
FIG. 13 is a cross-sectional view illustrating another example of an oil supply passage in the vane rotary compressor according to an embodiment.

FIG. 13 is a cross-sectional view illustrating another example of an oil supply passage in a vane rotary compressor according to an embodiment. As illustrated, an oil supply hole of the vane rotary compressor according to this embodiment may be configured as a third oil supply hole 1338 that axially penetrates the cylinder 133 and a fourth oil supply hole 1318 that radially penetrates the flange portion 1312 of the main bearing.

The third oil supply hole 1338 and the fourth oil supply hole 1318 communicate with each other, so as to form an inlet (or entry) end and an outlet (or exit) end, respectively. In this case, the inlet end of the third oil supply hole 1338 may be connected to an oil supply pipe 1319 so as to be immersed into oil stored in a bottom surface portion of the inner space of the casing 110.

The outlet end of the fourth oil supply hole 1318 may be formed to communicate with a side wall surface of the main-side first pocket 1313*a* as in the above-described embodiment. The outlet end of the fourth oil supply hole 1318 may be eccentrically formed toward the contact point P from the middle of the main-side first pocket 1313*a* in the circumferential direction.

In addition, the pressure reducing pin 1316 may be inserted into at least one of the third oil supply hole 1338 and the fourth oil supply hole 1318. As the fourth oil supply hole 1318 is formed in a horizontal direction (radial direction), installing the pressure reducing pin 1316 in the fourth oil supply hole 1318 may be more suitable in terms of installation or fixing.

Even if the oil supply hole is formed in the sub bearing, the cylinder, and the main bearing as in this embodiment, its basic configuration and effect are similar to the previous embodiment. Therefore, detailed description thereof has been omitted. However, in this embodiment, compared to the previous embodiment, it is more advantageous in that unevenness of the bearing surface caused by deformation or improper processing (or misworking) of the boss portion of the main bearing may be prevented. Although not shown in the drawing, the oil supply hole may also be formed through the sub bearing, the cylinder, and the main bearing.

Hereinafter, description will be given of a vane rotary compressor according to another embodiment. In the previous embodiments, the bearing protrusion is formed on the first pocket forming the intermediate pressure as well as the second pocket forming the discharge pressure among the back pressure pockets, and the communication flow path is formed on the bearing protrusions. However, in this embodiment, the second pocket is formed such that an inner circumferential side thereof is fully opened.

Figure 14:
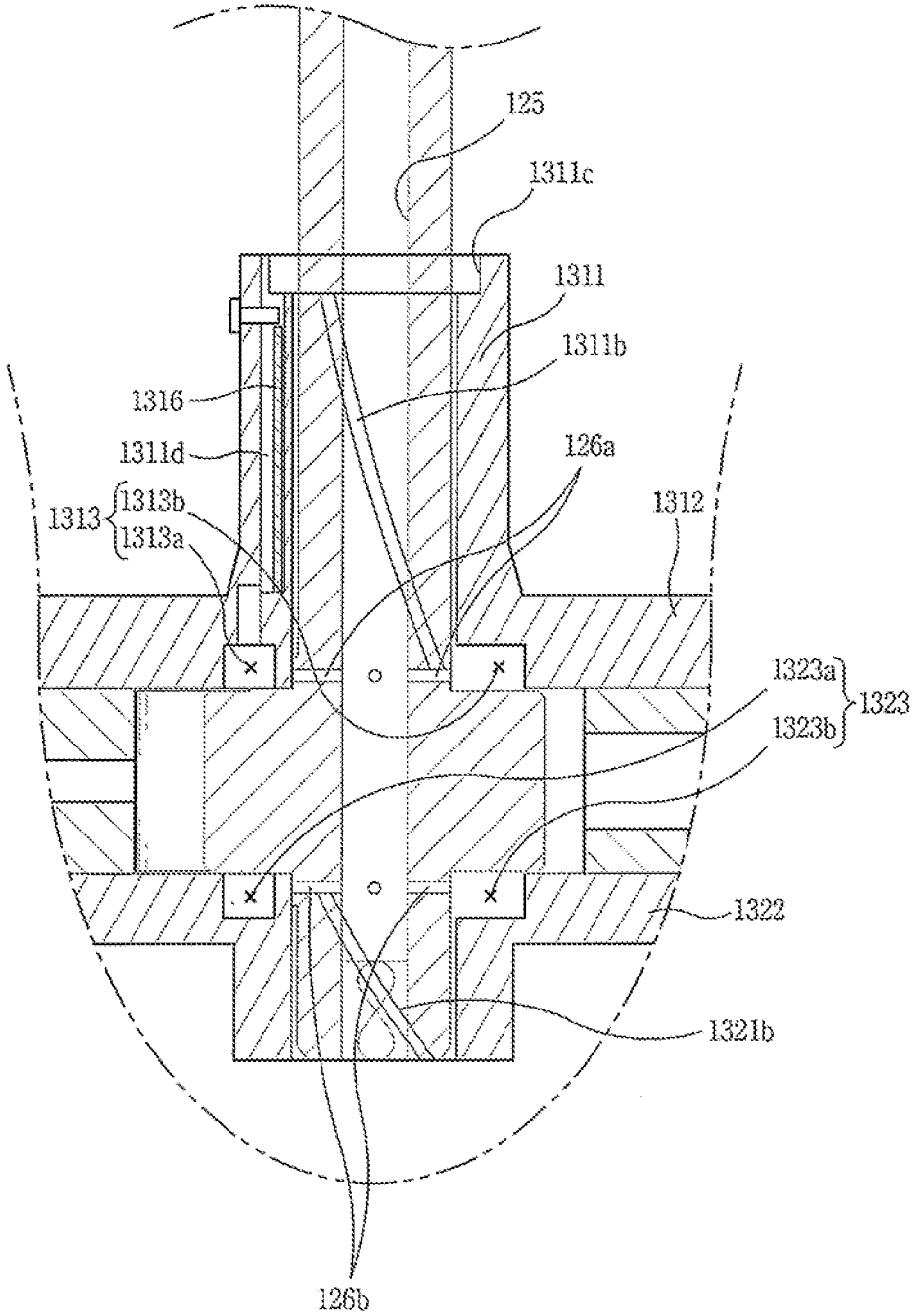
FIG. 14 is a cross-sectional view illustrating another embodiment of a vane rotary compressor employing the oil supply passage according to an embodiment.

FIG. 14 is a cross-sectional view of another embodiment of a vane rotary compressor employing the oil supply passage according to an embodiment. Referring to FIG. 14, oil may be more quickly and smoothly introduced into the second pockets 1313*b* and 1323*b* compared with the previous embodiments. That is, in the previous embodiments, flow resistance may occur as oil introduced between the outer circumferential surface of the rotational shaft 123 and the inner circumferential surface of the boss portion 1311, 1321 through the oil passage holes 126*a* and 126*b* flows into the respective second pockets 1313*b* and 1323*b* through the communication flow path 1315 and 1325.

Therefore, in this embodiment, the inner circumferential side of the second pockets 1313*b*, 1323*b* are opened so that oil may smoothly flow into the second pockets 1313*b* and 1323*b*, respectively. In this case, a depressurized refrigerant may also be introduced into the main-side first pocket 1313*a* through the oil groove 1311*b*, the oil accommodating groove 1311*c*, and the oil supply hole 1311*d* as in the previous embodiments. Accordingly, oil with the intermediate pressure may be smoothly supplied to the main-side and sub-side first pockets 1313*a* and 1323*a*, and thus, a sealing force of the vane in a corresponding range may be increased and noise caused by abnormal behavior of the vanes reduced.

In the previous embodiments, a single-type vane rotary compressor with one cylinder is used as an example. In some cases, however, the elastic bearing structure using the back pressure pocket as described above may be equally applied to a twin-type vane rotary compressor having a plurality of cylinders arranged in an axial direction. In this case, however, a middle plate may be provided between the plurality of cylinders, and the back pressure pocket described above may be formed on both sides of the middle plate in the axial direction, respectively.

Embodiments disclosed herein a vane rotary compressor capable of constantly and continuously supplying oil to a pocket forming low indeterminate pressure even in a high-pressure type vane rotary compressor. Embodiments disclosed herein further provide a vane rotary compressor capable of supplying oil introduced into a space between an outer circumferential surface of a rotational shaft and an inner circumferential surface of a bearing to a pocket having an intermediate pressure not only through a gap between a roller and the bearing but also through an oil supply passage by separately forming an oil supply passage in the bearing.

Embodiments disclosed herein provide a vane rotary compressor capable of supplying oil to a pocket in a constant and continuous manner regardless of an operating condition of the compressor by forming an oil guide passage, so that oil between a rotational shaft and a bearing is smoothly supplied through an oil supply passage when forming the oil supply passage at a boss portion or a flange portion of the bearing. Embodiments disclosed herein also provide a vane rotary compressor capable of smoothly supplying oil to a pocket forming an intermediate pressure when a high-pressure refrigerant, such as R32, R410a, and CO2 is used. Embodiments disclosed herein additionally provide a vane rotary compressor capable of smoothly supplying oil to a pocket forming intermediate pressure even under a low heating condition, a high pressure ratio condition, and a high speed operation condition.

Embodiments disclosed herein provide a vane rotary compressor that may include a pocket with intermediate pressure and a pocket with discharge pressure provided at a main bearing or a sub bearing. In the vane rotary compressor, an oil supply passage may be provided for guiding oil introduced into a space between a radial bearing surface of the main bearing or a radial bearing surface of the sub bearing and an outer circumferential surface of a rotational shaft facing the radial bearing surface of the main bearing or the sub bearing. The oil supply passage may be formed through an upper end of the main bearing and the pocket having the intermediate pressure.

Embodiments disclosed herein may further provide a vane rotary compressor having a pocket with an intermediate pressure and a pocket with a discharge pressure provided at a main bearing or a sub bearing. In the vane rotary compressor, an oil supply passage may be provided for guiding oil introduced into a space between a radial bearing surface of the main bearing or a radial bearing surface of the sub bearing and an outer circumferential surface of a rotational shaft facing the radial bearing surface of the main bearing or the sub bearing. A pressure reducing member may be inserted into the oil supply passage.

Embodiments disclosed herein may further provide a vane rotary compressor having a pocket with an intermediate pressure and a pocket with a discharge pressure provided at a main bearing or sub bearing. In the vane rotary compressor, an oil supply passage may be provided axially for guiding oil introduced into a gap between a radial bearing surface of the main bearing or a radial bearing surface of the sub bearing and an outer circumferential surface of a rotational shaft facing the radial bearing surface of the main bearing or the sub bearing. An oil accommodating groove with an annular shape may be provided on an upper end of the oil supply passage.

An oil groove that guides oil to the oil accommodating groove may be formed on an inner circumferential surface of the main bearing or the sub bearing facing the outer circumferential surface of the rotational shaft in a manner of communicating with the oil accommodating groove.

Embodiments disclosed herein provide a vane rotary compressor that may include a casing, a cylinder provided in an inner space of the casing, a main bearing and a sub bearing forming a compression space together with the cylinder, and provided with a plurality of back pressure pockets each having a different pressure formed on a surface facing the cylinder, a rotational shaft radially supported by the main bearing and the sub bearing, a roller provided with a plurality of vane slots formed along a circumferential direction and each having one end opened toward an outer circumferential surface, and a plurality of vanes slidably inserted into the vane slots of the roller and configured to divide the compression space into a plurality of compression chambers. At least one of the main bearing or the sub bearing may be provided with an oil supply passage for communicating a space between an outer circumferential surface of the rotational shaft and an inner circumferential surface of the main bearing facing the outer circumferential surface of the rotational shaft with the back pressure pocket of the main bearing or a space between the outer circumferential surface of the rotational shaft and an inner circumferential surface of the sub bearing facing the outer circumferential surface of the rotational shaft with the back pressure pocket of the sub bearing. The oil supply passage may communicate with a back pressure pocket having a relatively low pressure among the plurality of back pressure pockets.

The main bearing and the sub bearing may be provided with a boss portion extending from a flange portion defining the compression space by a predetermined height, respectively, so as to radially support the rotational shaft. The oil supply passage may be formed through the boss portion of at least one of the main bearing or the sub bearing.

The all supply passage may be formed through the oil boss portion. In addition, a pressure reducing member may be provided inside the oil supply passage.

The oil supply passage may be configured as a first oil supply passage communicating with an end surface of the boss portion, and a second oil supply passage extending from the first oil supply passage so as to communicate with the back pressure pocket. An axial center of first oil supply passage and an axial center of the second oil supply passage may be eccentrically formed with respect to each other. The first oil supply passage may be formed such that a portion of an end surface thereof overlaps an inside of the second oil supply passage, and the pressure reducing member may be axially supported on an end surface of the second oil supply passage.

An inner diameter of the second oil supply passage may be larger than an inner diameter of the first oil supply passage.

The end surface of the boss portion may be provided with an oil accommodating groove. The oil accommodating groove may be connected to the oil supply passage.

The oil accommodating groove may be formed on the end surface of the boss portion in a stepped manner along an inner circumferential surface of the boss portion. In addition, the oil accommodating groove nay be formed in a middle part or portion of the end surface of the boss portion, and provided with an oil communication groove penetrating toward the inner circumferential surface of the boss portion formed in an inner circumferential surface thereof.

The main bearing or the sub bearing may be provided with a flange portion extending therefrom and forming a compression space together with the cylinder. At least a part or portion of the oil supply passage may be formed through the flange portion of at least one of the main bearing or the sub bearing.

The oil supply passage may communicate with the inner space of the casing. An oil supply pipe extending toward the inner space of the casing may be insertedly coupled to an end of the oil supply passage. A pressure reducing member may be insertedly coupled to the oil supply passage or inside of the oil supply pipe. The oil supply passage, based on a rotational direction of the roller, may be eccentrically formed from an intermediate position in a circumferential direction of the pocket communicating with the oil supply passage, toward a contact point where the roller is the closest to the cylinder.

The plurality of pockets may include a first pocket having first pressure, and a second pocket having pressure higher than the first pressure. The oil supply passage may be formed to communicate with the first pocket.

At least one of the first pocket or the second pocket may be provided with a bearing protrusion formed on an inner circumferential side facing the outer circumferential surface of the rotational shaft to form a radial bearing surface with respect to the outer circumferential surface of the rotational shaft. The first pocket may be provided with the bearing protrusion, and the second pocket may be formed such that at least a part or portion of the inner circumferential side facing the outer circumferential surface of the rotational shaft is opened.

In a vane rotary compressor according to embodiments, an oil supply passage may be provided for communicating a space between an outer circumferential surface of a rotational shaft and an inner circumferential surface of a main bearing with a back pressure pocket forming intermediate pressure, so that oil, which is reduced to an intermediate pressure, may be constantly and continuously introduced into the back pressure pocket forming the intermediate pressure even in a high-pressure type vane rotary compressor. Accordingly, oil may be smoothly supplied to the back pressure pocket forming the intermediate pressure, and pressure in a back pressure chamber communicating with the back pressure pocket may be constantly maintained, thereby stably supporting a vane and securing a sealing force between the vane and a cylinder. As a result, compression efficiency may be improved by suppressing leakage between compression chambers, and compression efficiency may be improved by reducing vibration of the vane.

In addition, oil may flow into the back pressure pocket forming the intermediate pressure in a constant and continuous manner, thereby effectively lubricating between a bearing and a roller. Thus, mechanical efficiency may be improved by reducing friction loss between the bearing and the roller.

Further, in the vane rotary compressor according to embodiments, even if surface pressure against the bearing is increased when a high-pressure refrigerant, such as R32, R410a, and CO2, is used compared when a medium to low pressure refrigerant such as R134a is used, oil can be more smoothly supplied to the back pressure chamber, thereby suppressing leakage between compression chambers, noise, and friction loss.

In addition, in the vane rotary compressor according to embodiments, oil can be smoothly introduced into the back pressure chamber even under a low-temperature heating condition, a high pressure ratio condition, and a high-speed operating condition, thereby improving compressor efficiency, and efficiency of a refrigeration cycle device employing the compressor.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower" "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vane rotary compressor, comprising:

a casing;

a cylinder provided in an inner space of the casing;

a main bearing and a sub bearing forming a compression space together with the cylinder, and provided with a plurality of back pressure pockets each having a different pressure formed on a surface facing the cylinder;

a rotational shaft radially supported by the main bearing and the sub bearing;

a roller provided with a plurality of vane slots formed along a circumferential direction, each having a first end opened toward an outer circumferential surface; and a plurality of vanes slidably inserted into the plurality of vane slots of the roller, respectively, and configured to divide the compression space into a plurality of compression chambers, respectively, wherein at least one of the main bearing or the sub bearing is provided with an oil supply passage that provides communication between a space between an outer circumferential surface of the rotational shaft and an inner circumferential surface of the main bearing facing the outer circumferential surface of the rotational shaft and the plurality of back pressure pockets of the main bearing, or a space between the outer circumferential surface of the rotational shaft and an inner circumferential surface of the sub bearing facing the outer circumferential surface of the rotational shaft and the plurality of back pressure pockets of the sub bearing, wherein the oil supply passage communicates with a back pressure pocket having a relatively low pressure among the plurality of back pressure pockets, wherein the main bearing and the sub bearing are each provided with a boss portion that extends from a flange defining the compression space by a predetermined height, respectively, so as to radially support the rotational shaft, wherein the oil supply passage is formed through the boss portion of at least one of the main bearing or the sub bearing, wherein the oil supply passage is provided therein with a pressure reducing member, wherein the oil supply passage is configured as a first oil supply passage that communicates with an end surface of the boss portion, and a second oil supply passage that extends from the first oil supply passage so as to communicate with the back pressure pocket having the relatively low pressure, wherein an axial center of the first oil supply passage and an axial center of the second oil supply passage are eccentrically formed with respect to each other, and wherein the first oil supply passage is formed such that a portion of an end surface thereof overlaps an inside of the second oil supply passage, and wherein the pressure reducing member is axially supported on an end surface of the second oil supply passage.

2. The vane rotary compressor of claim 1, wherein the pressure reducing member is a pin.

3. The vane rotary compressor of claim 1, wherein the second oil supply passage has an inner diameter larger than an inner diameter of the first oil supply passage.

4. The vane rotary compressor of claim 1, wherein the end surface of the boss portion is provided with an oil accommodating groove, and wherein the oil accommodating groove is connected to the first oil supply passage.

5. The vane rotary compressor of claim 4, wherein the oil accommodating groove is formed on the end surface of the boss portion in a stepped manner along an inner circumferential surface of the boss portion.

6. The vane rotary compressor of claim 4, wherein the oil accommodating groove is formed at a middle portion of the end surface of the boss portion, and wherein the oil accommodating groove is provided with an oil communication groove that penetrates toward the inner circumferential surface of the boss portion formed in an inner circumferential surface thereof.

7. The vane rotary compressor of claim 1, wherein the main bearing or the sub bearing is provided with a flange that extends therefrom and forms the compression space together with the cylinder, and wherein at least a portion of the first oil supply passage and the second oil supply passage is formed through the flange of the at least one of the main bearing or the sub bearing.

8. The vane rotary compressor of claim 1, wherein the second oil supply passage, based on a rotational direction of the roller, is eccentrically formed from an intermediate position in a circumferential direction of the back pressure pocket communicating with the second oil supply passage, toward a contact point where the roller is the closest to the cylinder.

9. The vane rotary compressor of claim 1, wherein the plurality of back pressure pockets comprises:

a first back pressure pocket having a first pressure; and a second back pressure pocket having a pressure higher than the first pressure, and wherein the oil supply passage is formed to communicate with the first pocket.

10. The vane rotary compressor of claim 9, wherein at least one of the first back pressure pocket or the second back pressure pocket is provided with a bearing protrusion formed on an inner circumferential side facing the outer circumferential surface of the rotational shaft to form a radial bearing surface with respect to the outer circumferential surface of the rotational shaft.

11. The vane rotary compressor of claim 10, wherein the first back pressure pocket is provided with the bearing protrusion, and wherein the second back pressure pocket is formed such that at least a portion of the inner circumferential side facing the outer circumferential surface of the rotational shaft is opened.

* * * * *